US006695227B1

(12) United States Patent
Hayashi et al.

(10) Patent No.: US 6,695,227 B1
(45) Date of Patent: Feb. 24, 2004

(54) AEROSOL SPRAYING APPARATUS

(75) Inventors: Keiko Hayashi, Tokyo (JP); Masae Matsuoka, Chiba (JP); Akio Yamamoto, Chiba (JP); Kazuyoshi Takenaka, Tokyo (JP); Shusaku Tsutsumi, Hyogo (JP)

(73) Assignee: Earth Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/646,344

(22) PCT Filed: Jan. 4, 2000

(86) PCT No.: PCT/JP00/00001

§ 371 (c)(1),
(2), (4) Date: Sep. 18, 2000

(87) PCT Pub. No.: WO00/41949

PCT Pub. Date: Jul. 20, 2000

(30) Foreign Application Priority Data

| | | |
|---|---|---|
| Jan. 18, 1999 | (JP) | 11-009474 |
| Jan. 19, 1999 | (JP) | 11-010733 |
| Jun. 29, 1999 | (JP) | 11-183895 |
| Sep. 10, 1999 | (JP) | 11-257420 |
| Nov. 2, 1999 | (JP) | 11-312617 |

(51) Int. Cl.[7] ..... B05B 7/14

(52) U.S. Cl. ..... 239/337; 239/340; 239/343; 239/344; 239/373

(58) Field of Search ..... 239/337, 340, 239/343, 344, 373; 222/477, 179, 402.1, 402.13, 402.15

(56) References Cited

U.S. PATENT DOCUMENTS

| | | | | |
|---|---|---|---|---|
| 3,101,876 A | * | 8/1963 | Ayres | 222/402.13 |
| 4,752,020 A | * | 6/1988 | Grueter et al. | 222/153.14 |
| 4,805,839 A | * | 2/1989 | Malek | 222/402.1 |
| 4,860,933 A | * | 8/1989 | Morane et al. | 222/402.13 |
| 5,057,243 A | | 10/1991 | Becker et al. | 252/305 |
| 5,105,988 A | | 4/1992 | Knickerbocker | 222/148 |
| 5,232,127 A | * | 8/1993 | Trotta et al. | 222/402.13 |
| 5,263,616 A | * | 11/1993 | Abplanalp | 222/402.13 |
| 5,271,533 A | * | 12/1993 | Joulia | 222/402.13 |
| 5,305,930 A | * | 4/1994 | De Laforcade | 222/402.13 |
| 5,628,432 A | * | 5/1997 | Mosley | 222/402.1 |
| 5,732,855 A | * | 3/1998 | van der Heijden | 222/402.12 |
| 5,769,325 A | * | 6/1998 | Jouillat et al. | 222/333 |
| 5,862,960 A | * | 1/1999 | Miller et al. | 222/402.13 |
| 5,918,780 A | * | 7/1999 | Tanaka | 222/402.1 |
| 5,975,356 A | * | 11/1999 | Yquel et al. | 222/397 |
| 6,161,735 A | * | 12/2000 | Uchiyama et al. | 222/402.13 |

FOREIGN PATENT DOCUMENTS

| | | | | |
|---|---|---|---|---|
| EP | 0784024 A1 | * | 1/1997 | |
| JP | 7-9784 | | 2/1995 | B65D/83/34 |
| JP | 9-66977 | | 3/1997 | B65D/83/40 |
| JP | 10-230198 | | 9/1998 | B05B/9/04 |
| WO | WO 9405564 A1 | * | 3/1994 | B65D/83/22 |

* cited by examiner

*Primary Examiner*—Robin O. Evans
(74) *Attorney, Agent, or Firm*—Sughrue Mion, PLLC

(57) ABSTRACT

The present invention relates to an aerosol spraying apparatus which is compact in size, is easy to use, and is suitable for use in a state where it is installed on a floor. The aerosol container (11), including a stem (12) has a tip-preventing shape and, in the aerosol container (11), there are provided an operation portion (208) for operating the stem (12), and a spray orifice (207) for spraying aerosol contents jetted out from the stem (12) to the outside. The spray orifice (207) is structured such that it sprays the aerosol contents in the opposite direction from the operation position of the operation portion (208).

21 Claims, 21 Drawing Sheets

AEROSOL SPRAYING APPARATUS

TECHNICAL FIELD

The present invention relates to an aerosol spraying apparatus for spraying an aromatic, an insecticide, etc. Particularly, the present invention relates to an aerosol spraying apparatus suitable for use in a state in which it is installed on a floor etc.

BACKGROUND ART

Conventionally, there are proposed various aerosol spraying apparatuses. In the aerosol spraying apparatuses, there are an aerosol spraying apparatus of a type that an actuator is manually operated to spray an insecticide or the like, an aerosol spraying apparatus, from which an insecticide or the like is successively sprayed in a state where it is installed on a floor etc. (which is hereinafter referred to as "a whole-quantity sprayed type"), and so forth.

However, when an aerosol spraying apparatus is placed on a floor etc. and its actuator is manually operated, since a user must operate the actuator while stooping down over the aerosol spraying apparatus, it is inconvenient to use. Also, in this case, there is a possibility that aerosol contents such as an insecticide etc. can be sprayed toward the user and thus the user can inhale the aerosol contents. Especially, in the aerosol spraying apparatus of a whole-quantity sprayed type, this possibility is high. Also, there is proposed an aerosol spraying apparatus of a type that, for a given period of time after a user prepares an operation for spraying, the spraying of aerosol contents is not carried out, but the spraying of the aerosol contents can be started after the user leaves the room. However, since this type of aerosol spraying apparatus is large in size and is complicated in structure, manufacturing of such aerosol spraying apparatus is difficult and the manufacturing cost thereof is expensive. Further, a delay time from pressing down of a stem to spraying of the aerosol contents from the stem to the outside is liable to vary in every aerosol spraying apparatus. Furthermore, there is even a possibility that the aerosol contents cannot be sprayed actually.

It is an object of the present invention to provide an aerosol spraying apparatus which is compact in size and easy to handle, is capable of easy diffusion of aerosol contents, and is suitable for use in a state in which it is installed on a surface such as a floor etc.

DISCLOSURE OF THE INVENTION

The above object of the present invention can be achieved by an aerosol spraying apparatus which comprises an aerosol container including a stem provided with a stem opening for jetting aerosol contents, and an actuator which includes an operation portion for operating the stem, and a spray orifice communicated with the stem opening, the aerosol spraying apparatus characterized in that the operation portion and the spray orifice are arranged at different positions in order to prevent the aerosol contents to be sprayed from the spray orifice on operating the operation portion from being sprayed toward the operating position.

Here, the expression "the operation portion and the spray orifice are arranged at different positions" means that the operation portion and the spray orifice are arranged at the actuator in at least one of a manner that they are arranged at positions different from each other when viewed in the height direction of the aerosol spraying apparatus, and a manner that they are arranged at positions different from each other when viewed in a plan view of the aerosol spraying apparatus, so that the operation portion and the spray orifice are arranged at the actuator in such a manner as to satisfy one or the combination of those conditions, thereby being able to realize the effects of the present invention. The spray orifice is not limited to any special shape but includes not only a hole but also the end portion of guide means that guides the aerosol contents to be jetted out from the stem opening in a given direction.

According to the above aerosol spraying apparatus, while preventing the aerosol contents from being sprayed to the user, the whole quantity of the aerosol contents can be sprayed.

Further, the above object of the present invention can be achieved by an aerosol spraying apparatus which comprises an aerosol container including a stem provided with a stem opening for jetting aerosol contents, and, when in use, is installed through a bottom portion of the aerosol container, the aerosol spraying apparatus characterized in that slippage preventive means is disposed on the bottom portion of the aerosol container and prevents the aerosol spraying apparatus from slipping out of position on a surface onto which the aerosol spraying apparatus is installed.

In this aerosol spraying apparatus, it is preferable that an operation portion for operating the stem is further disposed. Also, as the operation portion, preferably, there may be employed a pedal which can be operated by treading it by foot.

According to such the aerosol spraying apparatus, when, in use, the aerosol container is installed on a surface such as a floor etc. and the stem is then operated, the slippage preventive means disposed on the bottom portion of the aerosol container can prevent the aerosol container from slipping out of position on the installation surface or falling down onto the installation surface. Accordingly, such the aerosol spraying apparatus is allowed to carry out its spraying operation easily, and is easy to use.

Further, the above object of the present invention can be achieved by an aerosol spraying apparatus which comprises an aerosol container including a stem provided with a stem opening for jetting aerosol contents, the aerosol spraying apparatus characterized in that the aerosol container has a shape hard to fall down, wherein the aerosol container is provided with a treading operation means including an operation portion which, when operated or trod by foot, can operate the stem, a spray orifice for spraying the aerosol contents to be jetted out from the stem at the time of the operation of the stem in a direction opposite to a direction toward a treading operation position in a plan view of the aerosol spraying apparatus, and a mounting portion which detachably retains the operation portion to one end of the aerosol container so that the operation portion covers the stem.

According to such the aerosol spraying apparatus, since the stem may be operated by the foot treading operation, a user does not need to stoop down. Also, the spraying direction of the aerosol contents is opposite to a direction toward the treading operation position. Therefore, the user may not inhale the aerosol contents. Here, the meaning of the expression "a direction opposite to a direction toward a treading operation position" comprises not only a direction along a line drawn so as to pass through the treading operation position in a plan view of the aerosol spraying apparatus but also a direction shifted in the range of 90° or less from the direction along above the line.

Further, the above object of the present invention can be achieved by an aerosol spraying apparatus which comprises an aerosol container including a stem provided with a stem opening for jetting aerosol contents, the aerosol spraying apparatus characterized in that the aerosol container has a shape hard to fall down, wherein the aerosol container is provided with a treading operation means including an operation portion which, when operated or trod by foot, can operate the stem, a spray orifice for spraying the aerosol contents to be jetted out from the stem at the time of the operation of the stem at an angle in the range of 30° to 85° with respect to an installation surface on which the aerosol container is placed and also in a direction opposite to a direction toward a treading operation position in a plan view of the aerosol spraying apparatus, and a mounting portion which detachably retains the operation portion to one end of the aerosol container so that the operation portion covers the stem.

According to such the aerosol spraying apparatus, since the spraying direction of the aerosol contents is not just above but a direction opposite to a direction toward the treading operation position and that an angular direction of 30° to 85° with respect to the installation surface of the aerosol container, the user may not inhale the aerosol contents. Also, by limiting the spraying direction of the aerosol contents to the above-mentioned angular range, the aerosol contents can be diffused effectively into the environmental atmosphere by the operation portion of a whole-quantity sprayed type.

Incidentally, in the above aerosol spraying apparatus, in case where the dimension of the treading operation means is set in dimension in such a manner that in a plan view of the aerosol spraying apparatus the treading operation means is not jutted out from the side wall surface of the aerosol container and also the treading operation means is detachably mounted onto the upper portion of the aerosol container so as to cover the stem, the treading operation means can be easily fitted with the aerosol container and that a further stabilized treading operation can be realized. Also, when using a cover for covering the treading operation means, since there can be employed a cover which is almost equal in size to the outside can diameter of the aerosol container, the whole configuration may be compact and it is easy to display them adjoining each other in the vertical direction as well as in the right and left directions. As the cover, there can be employed not only a cover of a type that it must be removed from the aerosol container before its operation portion can be operated, but also a cover of a type that allows the operation portion to be operated while the cover remains mounted on the aerosol container. Also, in case where slippage preventive means is mounted onto the bottom portion of the aerosol container, the operationability of the aerosol spraying apparatus can be further enhanced.

Further, the above object of the present invention can be achieved by an aerosol spraying apparatus which comprises an operation portion capable of pressing down a stem having a stem opening and disposed on the upper surface of an aerosol container, the aerosol spraying apparatus characterized by further comprising a connecting passage extending in an inclined direction with respect to an axial direction of the stem and communicating with the stem opening, and a spray orifice communicating with the connecting passage, whereby the operation portion can be pressed down around just above the stem without disturbing the spraying of the aerosol contents from the spray orifice.

Here, the expression "extending in an inclined direction with respect to an axial direction of the stem" comprises "extending in a direction at right angles to the axial direction of the stem" as well.

Also, the expression "around just above the stem" comprises not only just above the axial direction of the stem but also its peripheral portion, and thus a position "around just above the stem" may be any position, provided that, when pressing down the operation portion at such position, the aerosol spraying apparatus put on a surface such as a floor etc. can be prevented from falling down. Also, the connecting passage and spray orifice may be formed in the operation portion itself, or may be formed in a member formed separately from the operation portion. Further, the connecting passage may also be structured such that the length thereof can be adjusted.

According to the above aerosol spraying apparatus, the operation portion can be pressed down around just above the stem without disturbing the spraying of the aerosol contents from the spray orifice. Therefore, when the aerosol spraying apparatus is placed on a surface such as a floor etc. and the operation portion is then pressed down by foot, the aerosol spraying apparatus cannot be slipped out of position on the surface or fall down onto the surface. Also, since the spray orifice is arranged at a proper position by using the connecting passage, it is possible to prevent the aerosol contents from being sprayed toward the user.

Further, the above object of the present invention can be achieved by an aerosol spraying apparatus which comprises an operation portion capable of pressing down a stem having a stem opening and disposed on the upper surface of an aerosol container, the aerosol spraying apparatus characterized by further comprising slippage preventive means including a fixed portion extending outwardly in a radial direction of the aerosol container in a plan view of the aerosol spraying apparatus and fixed to an installation surface on which the aerosol container is placed, and a retaining portion, for retaining the aerosol container, connected to the fixed portion.

Here, although the fixed portion and the retaining portion of the slippage preventive means are not limited to specific shapes, for example, the fixed portion may be a band-like member and the retaining portion may be an annular member which can be fitted with the outside portion of the aerosol container.

It is preferable that the spray orifice is able to spray the aerosol contents in a direction opposite to a direction in which the fixed portion extends in a plan view of the aerosol spraying apparatus.

According to the above aerosol spraying apparatus, the fixed portion extending outwardly in the radial direction of the aerosol container is fixed by treading it by a heel, the operation portion of the aerosol container is operated by a toe, and the stem can be pressed down. At this time, since the aerosol container is retained by the retaining portion which is connected to the fixed portion of the slippage preventive means, the aerosol container is prevented from slipping with respect to the installation surface. Accordingly, this prevents the aerosol container from both slippage and fall, thereby being able to press down the stem positively.

Further, the above object of the present invention can be achieved by an aerosol spraying apparatus, in which a retarding member is interposed between a stem of an aerosol container and a spray orifice for spraying aerosol contents jetted out from the stem to the outside so as to retard spraying of the aerosol contents from the spray orifice, characterized in that the retarding member is constituted by a tubular body filled with a retardative object.

Here, the present inventors have found that the delay time of the aerosol contents can be stabilized without causing it to vary in case where, in a passage for the aerosol contents extending from the stem to the spray orifice, there is disposed a retardative object in a long length manner extending along the inner wall surface of the passage. However, it has been troublesome to execute an operation that silicone gel is poured into the passage to thereby dispose a long retardative object of a given dimension in a given place of the passage, and therefore, the productivity of an aerosol spraying apparatus having such structure has been low. In view of this, the present inventors have made every effort to find out a new and suitable structure and have successfully developed the structure that has been stated above.

As the retarding member, preferably, there may be used a member in which, after a retardative object is filled into the inside portion of a tubular body, its length can be adjusted. In order that the retarding member can be adjusted in length, for example, the retarding member may be structured such that it can be cut into a given length, or, in the leading and trailing ends of the retarding member, there may be formed engaging portions for engagement with another retarding member so that another retarding member can be removably combined with the retarding member in the axial direction thereof.

Here, the shape of the tubular body is not limited to a specific one but, for example, there can be used a resin tube or a metal tube. Also, as described above, the tubular body may include an engaging portion so that it can be adjusted in length.

The retardative object to be filled into the tubular body includes gelatinous substances, such as silicon gel, agar, jelly (gelatin), aqueous gel, and oily gel, and thixotropic substances.

In the thus structured aerosol spraying apparatus, a retarding member in a long length manner having a given dimension can be easily manufactured and also the thus manufactured retarding member can be easily assembled to a given portion of the aerosol spraying apparatus. Therefore, since the retarding member is easily manufactured, the manufacturing cost of the retarding member can be reduced. The retarding member in a long length manner is disposed in the passage for the aerosol contents, and therefore, a stabilized delay time can be obtained.

Further, the above object of the present invention can be achieved by an aerosol spraying apparatus which is characterized by comprising a spray orifice for spraying externally therefrom aerosol contents jetted out from a stem of an aerosol container, a passage allowing the stem and spray orifice to communicate with each other, and a retarding member disposed in the passage to retard spraying of the aerosol contents from the spray orifice, wherein the aerosol spraying apparatus further comprises a discharging chamber which communicates with the passage and into which the retarding member moved from the passage due to an internal pressure in the aerosol container can be discharged, and catching means for catching the retarding member disposed in the discharging chamber.

Here, the shape of the retarding member is not limited if it can be pushed out from the passage due to the internal pressure in the aerosol container. For example, there can be employed silicon gel, a highly viscous body, elastomer, etc. An especially preferable retarding member is a tubular body such as a resin tube, a metal tube, or the like which is filled with a retardative object.

The catching means is also not limited but, preferably, it may be retaining means which includes at least one of a recessed portion and a projecting portion capable of retaining the retarding member (or the retardative object). As the retaining means, there can be used a projecting portion, a recessed portion, or a lattice portion formed on the wall surface of the discharging chamber and, in the case of such retaining means, the mechanism of the retaining means can be simplified.

In the above structured aerosol spraying apparatus, in the retarded spraying operation, the retarding member discharged from the passage into the discharging chamber due to the internal pressure in the aerosol container can be caught by the catching means. This eliminates a possibility that the retarding member can move around within the discharging chamber and close the passage for the aerosol contents, which in turn makes it surely possible not only to prevent the delay time from varying but also to prevent a fear that the aerosol contents cannot be sprayed. Therefore, the aerosol contents can be sprayed accurately after a given-delay time passage.

Further, in an aerosol spraying apparatus of the present invention, a spray orifice member for use in the aerosol spraying apparatus may be constructed by mounting onto an aerosol container, the spray orifice member characterized by comprising a spray orifice for spraying aerosol contents jetted out form a stem of the aerosol container to the outside, a passage portion forming part of a passage for allowing the stem and the spray orifice to communicate with each other, a discharging chamber into which a retarding member moved from the passage due to the internal pressure in the aerosol container can be discharged and which communicates with the passage portion, and catching means for catching the retarding member, wherein the discharging chamber being provided with the catching means.

According to the above aerosol spraying apparatus, since the installation of the spray orifice member onto the aerosol container may be followed, the manufacture of the aerosol spraying apparatus can be facilitated. Therefore, the productivity of the aerosol spraying apparatus can be enhanced.

Of course, other various aerosol spraying apparatus, each of which is structured by combining together the respective characteristics of the various aerosol spraying apparatus illustrated hereinbefore, fall under the scope of the present invention.

The aerosol spraying apparatus illustrated hereinbefore can be respectively changed or modified and can also be structured as an aerosol spraying apparatus of a whole-quantity sprayed type including a mechanism which is capable of successively spraying of the aerosol contents. Also, each of the above-illustrated aerosol spraying apparatus can also include a retarded spraying mechanism which is capable of starting the spraying of the aerosol contents in a given time after the operation of the aerosol spraying apparatus is started.

Further, the aerosol spraying apparatus may be structured such that the aerosol container includes a vertically movable type of valve or an inclinable type of valve. The shape of the aerosol container is not limited to a specific one but, preferably, it may be a shape which is hard to fall down, for example, it may be a depressed shape such as a hollow and substantially hemi-spherical shape. However, the aerosol container can take any shape, provided that it is hard to fall down in any event. Similarly, the shape of the operation portion is not limited to any specific one; for example, there can be employed a pedal-like shape, a footboard-like shape, a stool-like shape, a button-like shape, or other similar shapes. Also, in the operation portion, preferably, there may be provided a stopper portion against which the tip(s) of toe(s) can be abut, in order to be able to facilitate the spraying operation by using foot. Further, the operation portion may also be structured as a separate member which can be mounted onto and removed from the aerosol container. Incidentally, the operation portion may also be manually operated.

The spray orifice in the aerosol spraying apparatus may also be structured in the following manner: that is, in the spray orifice, there is provided a well-known switching mechanism which can be switched to a plurality of stages, so that the spray orifice has two or more kinds of spray patterns. Also, the spray orifice may also be structured such that it sprays the aerosol contents in a direction inclined with respect to the axial direction of the stem, while the angle of the spray orifice may also be adjusted finely. The spray orifice may be provided two or more in number. Further, in the vicinity of the spray orifice, there may also be provided guide means which is used to guide the aerosol contents jetted out from the spray orifice toward a give direction.

In the present invention, as the aerosol contents, there can be used such aerosol contents that contain a propellant (liquefied and/or compressed gas) and a stock solution (a solvent, and a solute such as an insecticide, an insect repellent, a disinfectant (bactericide, fungicide), a deodorant, an aromatic, cosmetics, and a medicine); and, the compound ratio of them may range from 1:9 to 9:1 and a proper compound ratio can be selected from this range according to the objects of use.

As the aerosol contents, there can be employed the followings:

Useful propellant may be either liquefied or compressed. Examples of typical propellants are dimethyl ether (DME), liquefied petroleum gas (LPG), n-butane, isobutane, propane, isopentnae, n-pentane, cyclopentane, propylene, n-butylene, isobutylene, ethyl ether, carbonic acid gas, nitrogen gas, and Freon gases giving rise to no practical problem (e.g., HCFC22, 123, 124, 41b, 142b, and 225; HFC125, 134a, 143a, 152a, 12, and 227a). Preferred of them are DME, LPG n-butane, isobutane, propane, carbonic acid gas, nitrogen gas, and Freon 134a.

Examples of useful solvents include water, alcohols, such as methanol, ethanol, isopropyl alcohol, ethylene glycol, diethylene monobutyl ether, and ethylene glycol monomethyl ether; ketones, such as acetone, methyl ethyl ketone, and methyl isobutyl ketone; esters, such as methyl acetate, ethyl acetate, butyl acetate, and isopropyl myristate; ethyl ether; aliphatic hydrocarbons, such as n-hexane, kerosine, n-pentane, isopentane, and cyclopentane. These solvents can be used either individually or as a mixture thereof.

The active ingredients include insecticides, bactericides, fungicides, acaricides, insect repellants, aromatics, deodorants, and the like.

The insecticides preferably include pyrethroid compounds from the standpoint of safety. Typical examples of suitable insecticidal pyrethroid compounds are listed below:

dl-3-Allyl-2-methyl-4-oxo-2-cyclopentenyl dl-cis/trans-crythanthemate (general name: allethrin; trade name: Pynamin, produced by Sumitomo Chemical Co., Ltd.)

dl-3-Allyl-2-methyl-4-oxo-2-cyclopentenyl d-cis/trans-chrysanthemate (trade name: Pynamin Forte, produced by Sumitomo Chemical Co., Ltd.)

dl-3-Allyl-2-methyl-4-oxo-2-cyclopentenyl d-trans-chrysanthemate (general name: Bioallethrin, trade name: Esbiol, produced by Uclaf Co.)

d-3-Allyl-2-methyl-4-oxo-2-cyclopentenyl d-trans-chrysanthemate (trade name: Exthrin, produced by Sumitomo Chemical Co., Ltd.)

(5-Benzyl-3-furyl)methyl d-cis/trans-chrysanthemate (general name: resmethrin; trade name: Crysron Forte, produced by Sumitomo Chemical Co., Ltd.)

5-Propargyl-2-furylmethyl d-cis/trans-chrysanthemate (general name: furamethrin; trade name: Pynamin D Forte, produced by Sumitomo Chemical Co., Ltd.)

(+)-2-Methyl-4-oxo-3-(2-propenyl)-2-cyclopentenyl (+)-cis/trans-chrysanthemate (general name: prallethrin; trade name: Etoc, produced by Sumitomo Chemical Co., Ltd.)

dl-3-Allyl-2-methyl-4-oxo-2-cyclopentenyl dl-cis/trans-2,2,3,3-tetramethylcyclopropanecarboxylate (general name: terallethrin; produced by Sumitomo Chemical Co., Ltd.)

(1,3,4,5,6,7-Hexahydro-1,3-dioxo-2-isoindolyl)methyl dl-cis/trans-chrysanthemate (general name: phthalthrin; trade name: Neopynamin, produced by Sumitomo Chemical Co., Ltd.)

(1,3,4,5,6,7-Hexahydro-1,3-dioxo-2-isoindolyl)methyl d-cis/trans-chrysanthemate (trade name: Neopynamin Forte, produced by Sumitomo Chemical Co., Ltd.)

3-Phenoxybenzyl-d-cis/trans-chrysanthemate (general name: phenothrin; trade name: Sumithrin, produced by Sumitomo Chemical Co., Ltd.)

3-Phenoxybenzyl-dl-cis/trans-3-(2,2-dichlorovinyl)-2,2-dimethyl-1-cyclopropanecarboxylate (general name: permethrin; trade name: Eksmin, produced by Sumitomo Chemical Co., Ltd.)

(±)-α-Cyano-3-phenoxybenzyl (+)-cis/trans-chrysanthemate (general name: cyphenothrin; trade name: Gokilaht, produced by Sumitomo Chemical Co., Ltd.)

(±)-α-Cyano-3-phenoxybenzyl dl-cis/trans-3-(2,2-dimethyl-1-cyclopropanecarboxylate (general name: cypermethrin)

d-Trans-2,3,5,6-tetrafluorobenzyl-3-(2,2-dichlorovinyl)-2,2-dimethyl-1-cyclopropanecarboxylate (general name: transfluthrin)

Imiprothrin

Additionally included in useful insecticides are carbamate compounds, such as 2-isopropoxyphenyl-N-methyl carbamate (propoxur), oxadiazole compounds, such as methoxadiazon, and organophosphorous compounds, such as dimethyl 3-methyl-4-nitrophenylphosphorothionate (fenitrothione), and 2,2-dichlorovinyldimethyl phosphate (dichlorovos).

Typical examples of useful harmful insect repellants include:

2,3,4,5-bis(δ2-butylene)-tetrahydrofurfural, di-n-propyl isocinchomeronate, di-n-butyl succinate, 2-hydroxyethyloctyl sulfide, 2-t-butyl-4-hydroxyanisole, 3-t-butyl-4-hydroxyanisole, 1-ethynyl-2-methylpentenyl 2,2,3,3-tetramethylcyclopropanecarboxylate, 1-ethynyl-2-methyl-2-pentenyl 2,2-dimethyl-3-(2',2'-dichlorovinyl)cyclopropane-1-carboxylate, 1-ethynyl-2-methyl-2-pentenyl 2,2-dimethyl-3-(2',1'-propenyl)cyclopropane-1-carboxylate, and N-hexyl-3,4-dichloromaleimide.

Typical examples of useful acaricides include phenothrin, permethrin, resmethrin, 1,7,7-trimethylnorbornan-2-ylthiocyanoacetate (IBTA), IBTE, quaternary ammonium salts, benzyl benzoate, phenyl benzoate, benzyl salicylate, phenyl salicylate, 3-bromo-2,3-diiodo-2-propenyl ethylcarbonate, and 4-chlorophenyl-3-iodopropargylformal.

Hormones or anti-hormones of harmful insects which can be used in the composition include juvenile hormones, anti-juvenile hormones, and antimolting hormones. Typical examples are isopropyl (±)-(E,E)-11-methoxy-3,7,11-trimethyldeca-2,4-dienoate (methoprene), ethyl (E,E)-3,7,11-trimethyl-2,4-dodecadienoate (hydroprene), 2-[1-methyl-2-(phenoxyphenoxy)ethoxy]pyridine (pyriproxyphene), phenoxycarb, and imidazole compounds, such as 1-methyl-5-(2,6-dimethyl-1,5-heptadienyl) imidazole, 1-ethyl-5-(2,6-dimethyl-1,5-heptadienyl) imidazole.

Examples of useful bactericides or fungicides are p-chloro-m-xylenol (PCMX), 2,4,4'-trichloro-2'-hydroxydiphenyl ether (trade name: Irgasan DP-300), and 3-iodo-2-propynyl butylcarbamate (trade name: Troysan).

Examples of useful aromatics include natural perfumes, such as musk, bergamot oil, cinnamon oil, citronella oil, lemon oil, and lemongrass oil, and artificial perfumes, such as pinene, limonene, linalool, menthol, borneol, eugenol, citral, citronellal, heliotropine, and vanillin.

Examples of useful deodorants are lauryl methacrylate, geranyl crotonate, acetophenone myristate, p-methylacetophenone, and benzaldehyde.

BEST MODE FOR CARRYING OUT THE INVENTION

Now, description will be given below of the best preferred embodiments of the present invention with reference to the accompanying drawings. However, the present invention is not limited to these embodiments.

Figure 1:
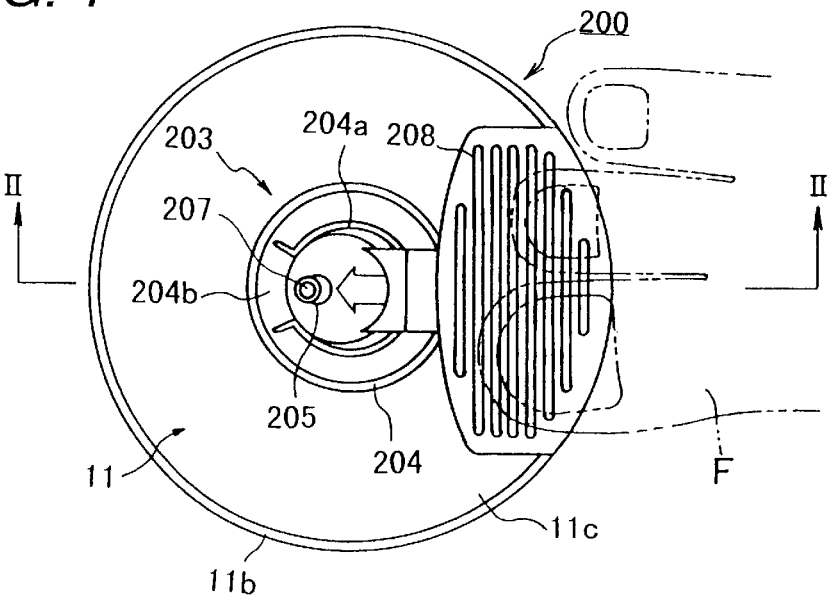
FIG. 1 is a plan view of a first embodiment of an aerosol spraying apparatus according to the present invention.
Figure 2:
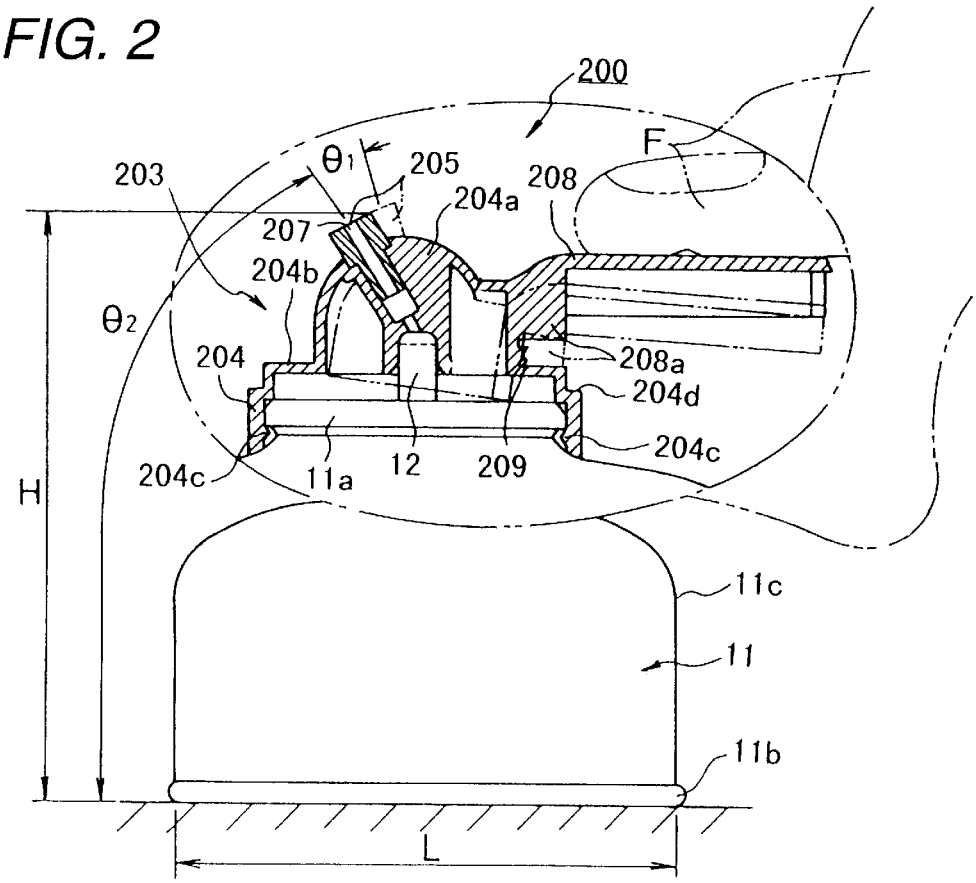
FIG. 2 is a section view taken along the line II—II shown in FIG. 1.

FIGS. 1 and 2 shows an aerosol spraying apparatus 200 according to a first embodiment of the present invention. The aerosol spraying apparatus 200 is structured such that an actuator 203 is removably fitted with the upper portion of an aerosol container 11. The actuator 203 is mounted on the aerosol container 11 through a tubular mounting portion 204. At the lower end of the inner periphery of the mounting portion 204, there is provided a retaining projection 204*c* which can be engaged with a winding portion 11*a* formed in the upper portion of the aerosol container 11. Also, at the upper end of the mounting portion 204, there is formed a plane portion 204*b* which extends inwardly in the diameter direction of the mounting portion 204. Between the upper end and plane portion 204*b* of the mounting portion 204, there is provided a step 204*d*.

The actuator 203 further includes a movable portion 204*a* for covering a stem 12, and a pedal 208 formed as a plate-shaped operation portion which extends from the movable portion 204*a* in a direction substantially parallel to the installation surface of the actuator 203. The movable portion 204*a* is supported by part of the plane portion 204*b* in a cantilevered manner on the opposite side to the side where the pedal 208 is positioned, in a plan view of the aerosol spraying apparatus 200. The leading end of the stem 12 is inserted into the lower portion of the movable portion 204*a*. Also, into the upper portion of the movable portion 204*a*, there is inserted a stem opening portion 205 including a spray orifice 207 which communicates with the stem opening of the stem 12. The opening direction of the spray orifice 207 is here inclined, in a plan view of the aerosol spraying apparatus 200, to the opposite side of the side where the pedal 208 is positioned with respect to a direction just above the stem 12 which is also the opening direction of the stem opening of the stem 12.

The stem 12, when the aerosol spraying apparatus 200 is not in use, is positioned at a position shown by a solid line in FIG. 2. And, when the aerosol spraying apparatus 200 is in use, in case that the pedal 208 is trod by foot, the movable portion 204*a* is inclined with a portion thereof cantilevered by the plane portion 204*b* as a fulcrum and is pressed down. And, in case that the movable portion 204*a* is inclined down to a position, which is shown by an imaginary line in FIG. 2, where a stopper 208*a* disposed below the pedal 208 is contacted with the plane portion 204*b*, the movable portion 204*a* is secured to the plane portion 204*b* in its inclined state by a securing pawl 209 provided in the neighborhood of the stopper 208*a*. Due to this, the stem 12 is also fixed as it remains pressed down or inclined, so that the aerosol contents are continuously jetted out from the stem opening formed in the leading end of the stem 12. In this case, the stem opening portion 205 is inclined on the upper side by a moving angle θ1 from its initial position.

In the present embodiment, the sum of the moving angle θ1 and an angle θ2 formed by the installation surface of the aerosol spraying apparatus 200 and the opening direction of the spray orifice 207 of the stem opening portion 205 at its initial position is set in the range of 30° to 85°. Also, the height H of the whole of the aerosol spraying apparatus 200 is set equal to or less than the diameter L of the bottom portion of the aerosol container 11. Also, the dimension of the pedal 208 is set such that the pedal 208 does not project from the side surface 11*c* of the aerosol container 11 in a plan view of the pedal 208.

According to the above-structured aerosol spraying apparatus 200, because the user does not need to stoop over the aerosol container 11 and also because the aerosol contents are sprayed on the opposite side to the operation portion 208, there is no fear that the user can inhale the aerosol contents when they are sprayed.

Also, since the sum of the moving angle θ1 and an angle θ2 formed by the installation surface of the aerosol spraying apparatus 200 and the opening direction of the spray orifice 207 of the stem opening portion 205 at its initial position is set in the range of 30° to 85°, it is possible to prevent the aerosol contents from splashing onto the user more positively. And, the aerosol contents can be effectively diffused into the surrounding atmosphere.

Further, because the stopper 208*a* disposed below of the pedal 208 is contacted with the plane portion 204*b* when the pedal 208 is trod by foot, there is no possibility that the opening direction of the spray orifice 207 can reach just above the aerosol spraying apparatus 200, which makes it possible to prevent the aerosol contents from splashing onto the user positively.

Also, since the height H of the whole of the aerosol spraying apparatus 200 is set equal to or less than the diameter L of the bottom portion of the aerosol container 11 and also since the dimension of the pedal 208 is set in such a manner that the pedal 208 does not project from the side surface 11*c* of the aerosol container 11 in a plan view of the aerosol spraying apparatus 200, there is no fear that, when the pedal 208 is trod by foot, the aerosol spraying apparatus 200 can fall down, which makes it possible to carry out the spraying operation positively.

Figure 3:
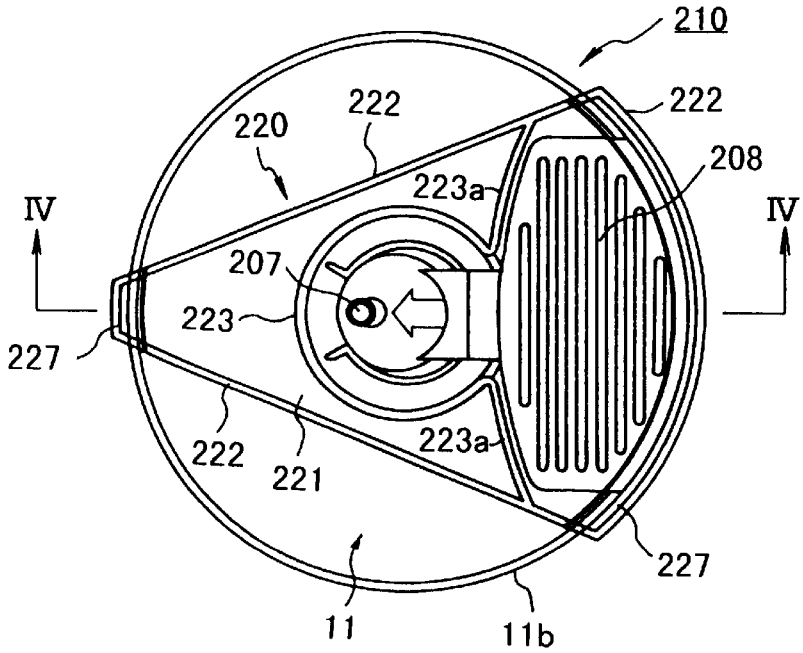
FIG. 3 is a plan view of a second embodiment of an aerosol spraying apparatus according to the present invention.
Figure 4:
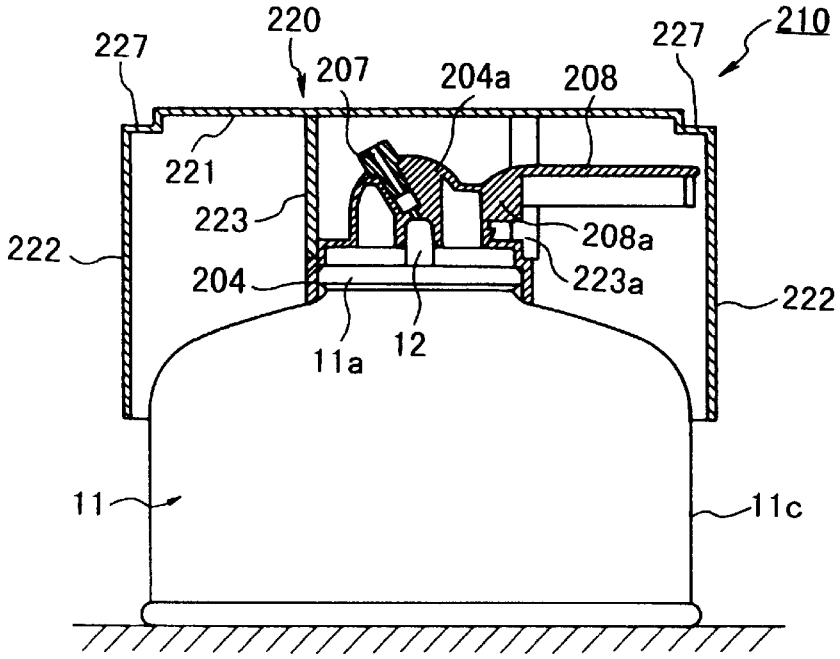
FIG. 4 is a section view taken along the line IV—IV shown in FIG. 3.

Now, FIGS. 3 and 4 show a second embodiment of an aerosol spraying apparatus according to the present invention. By the way, the previously described parts are given the same or like designations and thus the description thereof is simplified or omitted here. The second embodiment, that is, an aerosol spraying apparatus 210 is structured such that an upper portion cover 220 consisting of a molding formed transparent synthetic resin is put on the upper portion of the aerosol container 11. The cover 220, which has a triangular shape in a plan view thereof, covers part of the aerosol container 11 and an actuator. In the inside of the cover 220, from a ceiling board 221, there hang down a tubular mounting wall 223 which can be fitted with the step 204*d* (see FIG. 2) of a mounting portion 204, and a support wall 223*a* for supporting the ceiling board 221 from below. Also, from the outer edge portion of the ceiling board 221, there hangs down a side wall 222. Further, at a given position on the upper surface of the outer edge portion of the ceiling board 221, there is formed a step-shaped piling portion 227 in such a manner that another aerosol container can be piled thereon.

According to the above-structured aerosol spraying apparatus 210, in the transport and safekeeping thereof, two or more aerosol spraying apparatus can be packed up while they are piled on top of another and also can be displayed in the store while they are piled on top of another; that is, the aerosol spraying apparatus 210 is excellently convenient to handle. Also, even if the aerosol spraying apparatus 210 is dropped down onto a floor etc. by mistake, there is no fear that the pedal 208 can be pressed down, thereby being able to prevent the aerosol contents from being sprayed undesirably. Further, the spraying of the aerosol contents due to the mischief of a baby can also be prevented positively.

By the way, in the present embodiment, the cover 220 is formed transparent. However, this is not limitative but, for example, it may be colored or it may be translucent.

Figure 5:
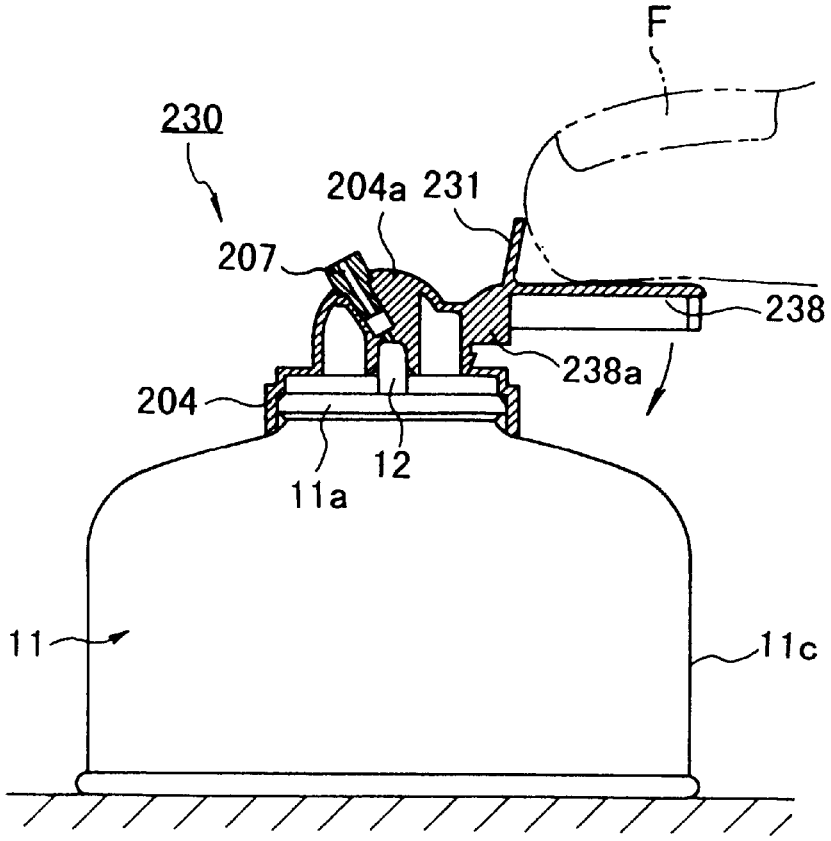
FIG. 5 is a section view of a third embodiment of an aerosol spraying apparatus according to the present invention.

Now, FIG. 5 shows an aerosol spraying apparatus 230 which is a third embodiment according to the present invention. The aerosol spraying apparatus 230 is structured such that, in a pedal 238, there is formed a positioning stopper portion 231. When putting a foot F on the pedal 238, by pressing the tiptoe of the foot F against the stopper portion 231, the foot F can be positioned, thereby being able to tread the pedal 238 positively and easily. This makes it also possible to positively prevent a spray orifice 207 from being closed by the foot F.

Figure 6A:
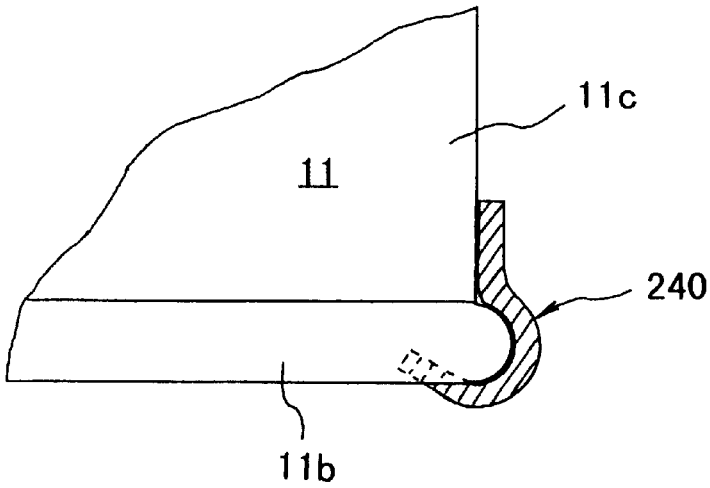
FIGS. 6A and 6B are enlarged views of the main portions of fourth and fifth embodiments of an aerosol spraying apparatus according to the present invention.

Now, FIG. 6A is an enlarged view of the main portions of a fourth embodiment of an aerosol spraying apparatus according to the present invention. In the present embodiment, in the peripheral edge of the bottom portion 11*b* of an aerosol container 11, there is provided slippage preventive means 240 in such a manner that it extends along the whole periphery of the bottom portion 11*b*. Here, as the slippage preventive means 240, there is employed a seal member which extends from the side surface 11*c* of the aerosol container 11 to the bottom portion 11*b* thereof. Provision of this seal member enhances a friction force acting between the bottom portion 11*b* of the aerosol container 11 and the installation surface of the aerosol container 11 to thereby prevent the aerosol container 11 from slipping out of position on the installation surface or falling down onto the installation surface, so that a good operationability can be obtained in the aerosol container 11. As the seal member, there can be employed a rubber-system member formed of synthetic rubber or natural rubber which has a high coefficient of friction and is thus hard to slip, or a member which is composed of a urethane-system base member and acryl-system adhesive agent coated on the base member.

Figure 6B:
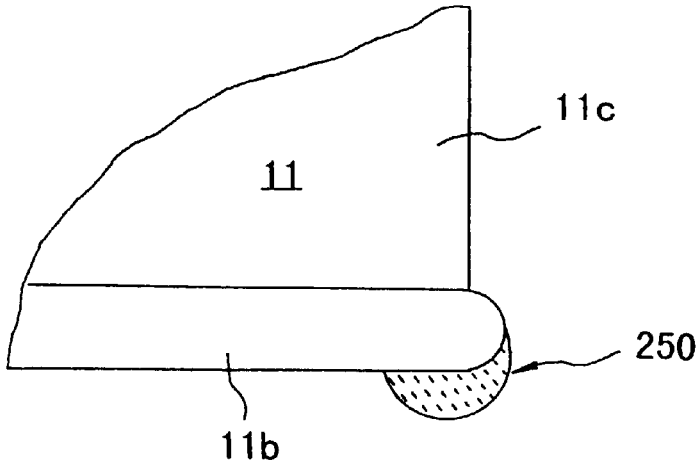

Now, FIG. 6B is an enlarged view of the main portions of a fifth embodiment of an aerosol spraying apparatus according to the present invention. In the present embodiment, in the whole peripheral edge of the bottom portion 11*b* of an aerosol container 11, there is provided slippage preventive means 250. Here, the slippage preventive means 250 is formed by coating a hot-melt agent onto the peripheral edge of the bottom portion 11*b*. In case where the hot-melt agent is coated too much, the hot-melt agent is easy to peel off and, therefore, as the coating amount of the hot-melt agent, a range of 0.1–0.5 grams is suitable. As the material of the hot-melt agent, preferably, there may be used polyamide.

In the embodiments respectively shown in FIGS. 6A and 6B, the slippage preventive means 240 and 250 are respectively provided along the whole peripheral edge of the bottom portion of the aerosol container. However, this is not limitative but slippage prevent means can also be provided in a plurality of portions of the peripheral edge of the aerosol container bottom portion 11*b* which are spaced from one another in the peripheral direction of the bottom portion 11*b*. Especially, preferably, in three or more portions of the bottom portion 11*b*, there may be provided slippage preventive means in such a manner that they swell up from the bottom portion 11*b*.

When the slippage preventive means is provided in only one portion of the peripheral edge of the aerosol container bottom portion 11*b*, preferably, in order that the slippage preventive means can cover the peripheral edge of the bottom portion 11*b* over a given length, the slippage preventive means may be formed in an arc shape when it is viewed from the bottom surface thereof. Also, when the slippage preventive means is provided in two portions of the peripheral edge of the aerosol container bottom portion 11*b* which are spaced from each other in the peripheral direction of the bottom portion 11*b*, preferably, in order that the two slippage preventive means can respectively cover the mutually opposing portions of the peripheral edge of the bottom portion 11*b* over a given length the two slippage preventive means may be respectively formed in an arc shape when they are viewed from the bottom surface of the bottom portion 11*b*.

Also, in the embodiments respectively shown in FIGS. 6A and 6B, the slippage preventive means 240 and 250 are respectively formed in an annular shape which covers the bottom portion 11*b* of the aerosol container. However, they may also be formed respectively in a flat plate shape. In this case, preferably, on the upper surface of the flat-plate-shaped slippage preventive means, there may be provided a rib which can be fitted with the peripheral edge of the bottom portion 11*b* of the aerosol container. The rib is not limited in the structure thereof and, for example, there can be employed a structure in which a rib is composed of concentrically disposed inside and outside annular-shaped ribs, and the peripheral edge of the bottom portion 11*b* of the aerosol container can be fitted into between the two inside and outside ribs.

Further, as the method for forming the slippage preventive means shown in FIG. 6B, there is shown a method using a hot melt agent. However, according to the present invention, the slippage preventive means may also be formed according to other methods.

Figure 7:
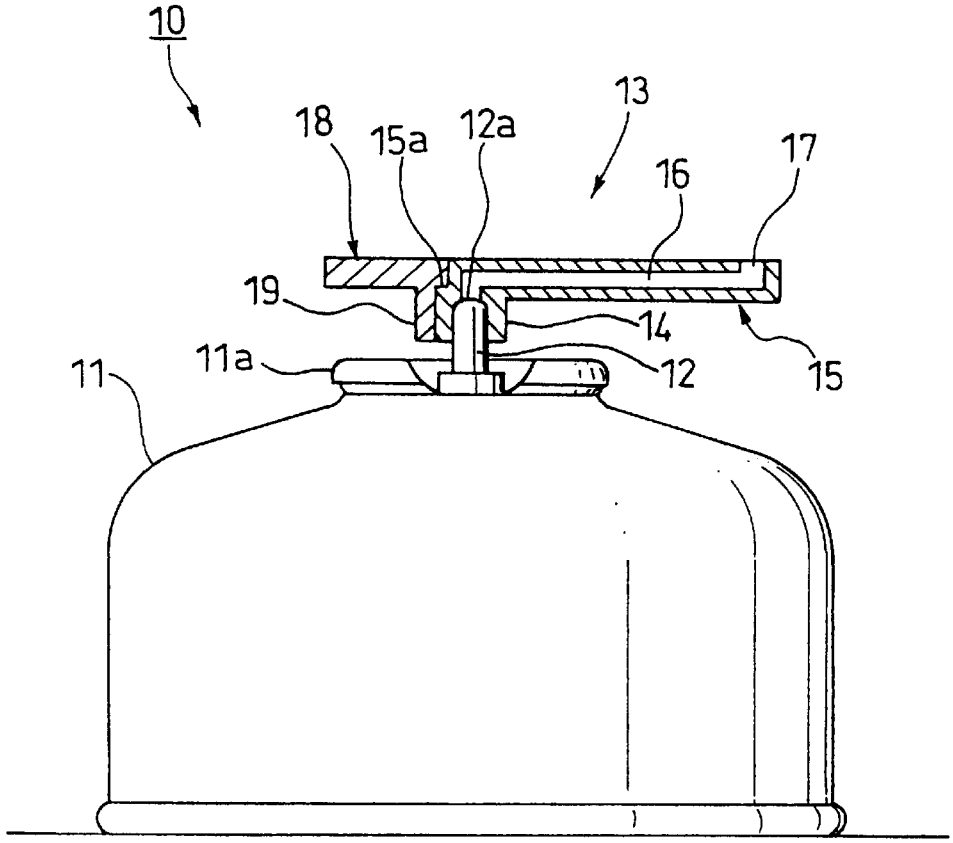
FIG. 7 is a section view of a sixth embodiment of an aerosol spraying apparatus according to the present invention.
Figure 8:
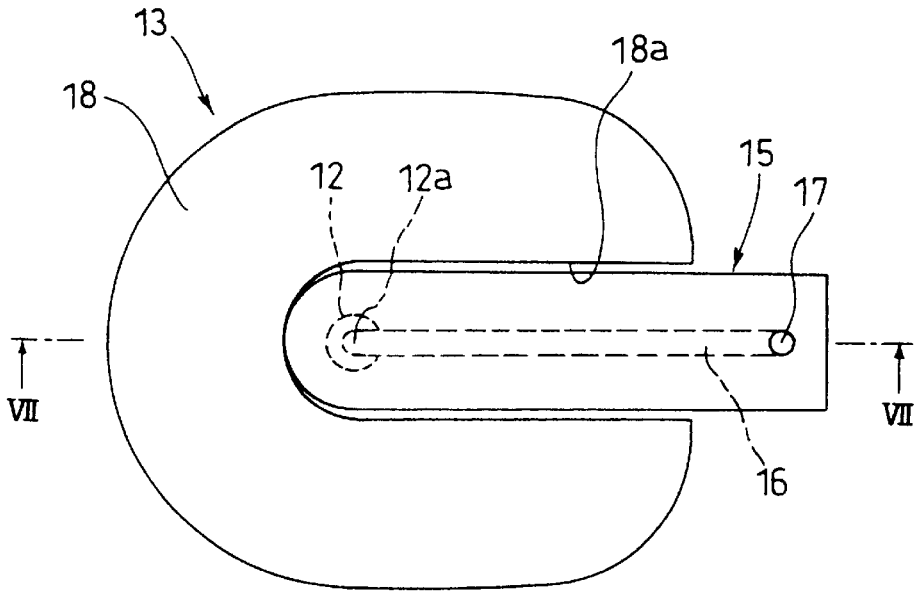
FIG. 8 is a plan view of the sixth embodiment shown in FIG. 7.

Now, FIGS. 7 and 8 show an aerosol spraying apparatus 10 which is a sixth embodiment according to the present invention. The aerosol spraying apparatus 10 includes an aerosol container 11 which is low in height and has a substantially cylindrical shape or a substantially hemispherical shape when it is viewed from outside; and, in the central portion of a mountain cup formed in the upper surface of the aerosol container 11, there is disposed a stem 12 in such a manner that it can be slid in the vertical direction. And, on the upper end of the stem 12, there is detachably mounted an actuator 13. By the way, in FIG. 7, the actuator 13 is shown in the form of a section view taken along the line VII—VII shown in FIG. 8.

As shown in FIG. 7, the actuator 13 includes a tubular mounting portion 14 which can be fitted with the outer periphery of the stem 12, and a band-shaped passage portion 15 which has an end portion connected to the upper end of the mounting portion 14 and extends in a direction perpendicular to the axial direction of the mounting portion 14 and stem 12. Within the passage portion 15, there are formed a connecting passage 16 which has one end communicating with the stem opening 12*a* of the stem 12 and extends in a direction parallel to the passage portion 15, and a spray orifice 17 communicating with the other end of the connecting passage 16 and opened in a direction perpendicular to the passage portion 15. That is, the spray orifice 17 is disposed at a position which, in a plan view of the actuator 13, is eccentric with respect to the stem opening 12*a* of the stem 12. Also, in the passage portion 15, in particular, in the end portion thereof on the stem 12 side, there is formed a step 15*a* which serves as a securing portion.

On the passage portion 15, there is mounted a pedal 18 which extends in parallel to the passage portion 15 and is formed in a plate body. In the present embodiment, the pedal 18 is produced as a separate member and is detachably mounted on the passage portion 15, while the pedal 18 is secured by the step 15*a* of the passage portion 15 and is thereby restricted in its movement in the downward direction. Also, the pedal 18 includes a support portion 19 which extends along the outer periphery of the mounting portion 14.

As shown in FIG. 8, the pedal 18 is made of a substantially elliptical-shaped plate including a slit 18*a* from which, in a plan view of the pedal 18, the passage portion 15 can be exposed. The end portion of the passage portion 15 on the spray orifice 17 side projects from the peripheral edge of the pedal 18, and the spray orifice 17 is positioned in the projecting portion of the passage portion 15.

In the present embodiment, the passage portion 15 and pedal 18 cooperate together in forming the operation portion of the aerosol spraying apparatus. By the way, in FIG. 8, the illustration of the aerosol container 11 is omitted.

To use this aerosol spraying apparatus 10, at first, a user may put his or her foot on the passage portion 15 and pedal 18 respectively shown in FIG. 8. In this case, while confirming the position of the passage portion 15, the foot is put at such a position where an external force capable of pressing down the stem 12, which is located below the passage portion 15, straight in the axial direction thereof can be applied. Next, the passage portion 15 and pedal 18 are trod by foot, with the result that the aerosol contents can be sprayed out from the spray orifice 17.

According to the above structured aerosol spraying apparatus 10, without interfering the spraying of the aerosol contents from the spray orifice 17, the passage portion 15 and pedal 18 can be pressed down just above the stem 12 and around just above the stem 12. For this reason, when the aerosol spraying apparatus 10 is placed on a floor etc. and the operation portion thereof is pressed down by foot, there is no fear that the aerosol spraying apparatus 10 can slip out of position on the floor etc. or fall down onto the floor etc. Also, since the spray orifice 17 is arranged at a position distant from the body of the user, it is also possible to prevent the aerosol contents from being sprayed toward the user.

And, provision of the pedal 18 increases the area of the portion to be pressed in a plan view of the present portion, which can facilitate the placement of the foot onto the portion, thereby being able to press down the stem 12 stably. Also, because the passage portion 15 is exposed from the pedal 18 in a plan view of the aerosol spraying apparatus 10, it is easy to confirm the center of the aerosol spraying apparatus 10 in which the stem 12 is positioned. This makes it possible to prevent the slippage and fall of the aerosol spraying apparatus 10 further positively.

Also, since the actuator 13 can be removed from the aerosol container 11, in case where the aerosol container 11 becomes empty, the actuator 13 can also be mounted onto another aerosol container.

Further, because the pedal 18 can be removed from the passage portion 15, when packing, there is no possibility that the pedal 18 can make the aerosol spraying apparatus 10 bulky.

Figure 9:
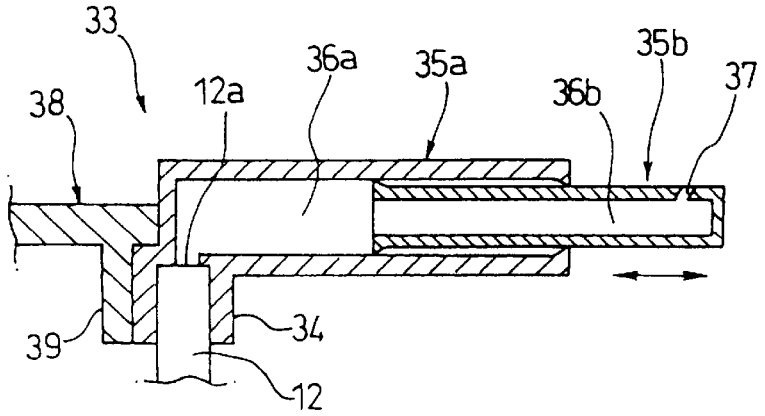
FIG. 9 is an enlarged view of the main portion of a seventh embodiment of an aerosol spraying apparatus according to the present invention.

Now, FIG. 9 shows a seventh embodiment of an aerosol spraying apparatus according to the present invention. Specifically, the seventh embodiment is different from the sixth embodiment only in the passage portion thereof. And, the remaining portions of the seventh embodiment are the same as those of the sixth embodiment and thus the illustration thereof is omitted in FIG. 9. Also, the parts already described hereinbefore are given the same or like designations and thus the description thereof is simplified or omitted here.

An actuator 33 shown in FIG. 9 includes a first band-shaped passage portion 35*a* and a second band-shaped passage portion 35*b*. Within the first passage portion 35*a*, there is disposed a first connecting passage 36*a* which extends in a direction parallel to the first passage portion 35*a* and has one end communicating with the stem opening 12*a* of a stem, with the other end opened. And, the second passage portion 35*b* is slidably fitted into the first passage portion 35*a* from the opened side of the first connecting passage 36*a*; and, within the second passage portion 35*b*, there is disposed a second connecting passage 36*b* which extends in a direction parallel to the second passage portion 35*b* and has one end communicating with the first connecting passage 36*a*. Also, in the other end portion of the second passage portion 35*b*, there is formed a spray orifice 37 which communicates with the second connecting passage 36*b* and extends in a direction inclined with respect to a direction perpendicular to the second passage portion 35*b*. Here, the spray orifice 37 is inclined in such a manner that the aerosol contents are caused to fly toward a direction apart from the stem 12.

According to the above structured aerosol spraying apparatus, since the length of the passage portion can be changed according to the need of a user, the present aerosol spraying apparatus is very convenient to use. Also, because the spray orifice 37 is inclined with respect to a direction perpendicular to the passage portion 35*b* and is opened in a direction apart from the stem, it is possible to further positively prevent the aerosol contents from being sprayed toward a user.

Figure 10:
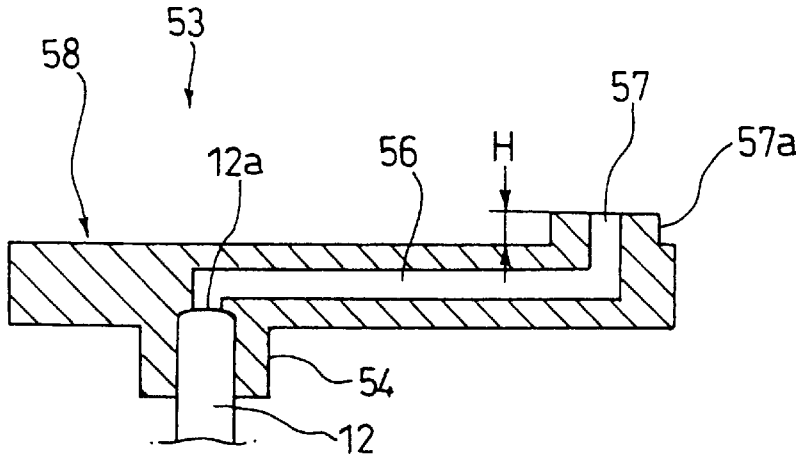
FIG. 10 is an enlarged view of the main portion of an eighth embodiment of an aerosol spraying apparatus according to the present invention.
Figure 11:
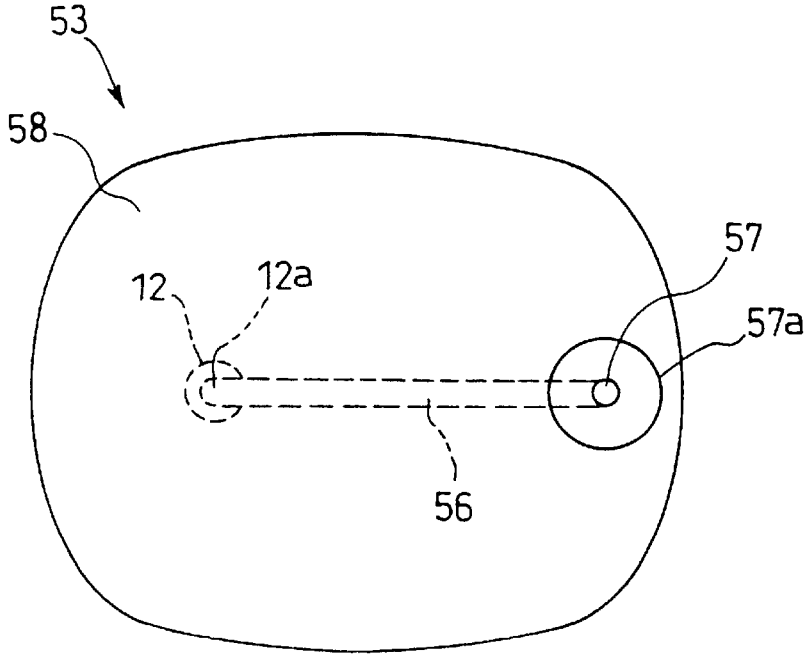
FIG. 11 is a plan view of the eighth embodiment shown in FIG. 10.

Now, FIGS. 10 and 11 show an eighth embodiment of an aerosol spraying apparatus according to the present invention. In this embodiment, an actuator 53 includes a substantially elliptical-plate-shaped pedal 58 having a connecting passage 56 formed therein. The connecting passage 56 extends in a direction parallel to the pedal 58, while one end thereof communicates with the stem opening 12*a* of a stem. With the other end of the connecting passage 56, there communicates a spray orifice 57 which extends in a direction perpendicular to the pedal 58. By the way, as shown in FIG. 10, in order that the open upper surface of the spray orifice 57 can be higher by a height H than the upper surface of the pedal 58, there is formed on the upper surface of the pedal 58 a step portion 57*a* which serves as a stopper portion.

According to the above structured aerosol spraying apparatus, the number of parts required in the actuator 53 can be reduced, thereby being able to lower the manufacturing cost of the actuator 53. Also, since the step portion 57*a* is formed on the upper surface of the pedal 58, for example, in case where the toe(s) of foot is (are) contacted with the side surface of the step portion 57*a* and the pedal 58 is trod by the foot, the stem can be positively pressed down straight. By the way, in this case, there is no possibility that such operation can interfere with the spraying of the aerosol contents from the spray orifice 57.

Here, according to the above-mentioned sixth to eighth embodiments, since the operation portion can be pressed down around just above the stem, in case where they are used correctly, there is no fear that the aerosol container 11 can slip on its installation surface. However, in case where a user is going to press down the end portion of the operation portion by mistake, there arises a possibility that the aerosol container 11 can slip on the installation surface or can fall down onto the installation surface. In order to avoid this, on the bottom portion of the aerosol container 11, there can also be mounted such slippage preventive means as used in the fourth or fifth embodiment.

Also, in the above-mentioned sixth to eighth embodiments, although the actuators 13, 33 and 53 are respectively mounted on their associated stems 12, similarly to the previously described first to third embodiments, the lower portion of the actuator may also be fitted with the outside of the winding portion 11*a*.

Further, the lower portion of the actuator may also be fitted with the inside of the winding portion 11*a*; or, there may be provided a tubular portion for covering the outer periphery of the lower portion of the stem, there may be cut a thread in the outer periphery of the tubular portion, and the lower portion of the actuator may be threadedly engaged with the tubular portion. In addition, there can also be employed such a structure in which there is provided a button for covering the leading end of the stem, there is provided a guide tubular portion which surrounds the outer periphery of the button and with which the button outer periphery can be threadedly engaged, and, in case where an operation portion such as a pedal is operated, the button can be pressed down while rotating. These structures can be employed in the other embodiments as well.

Figure 12:
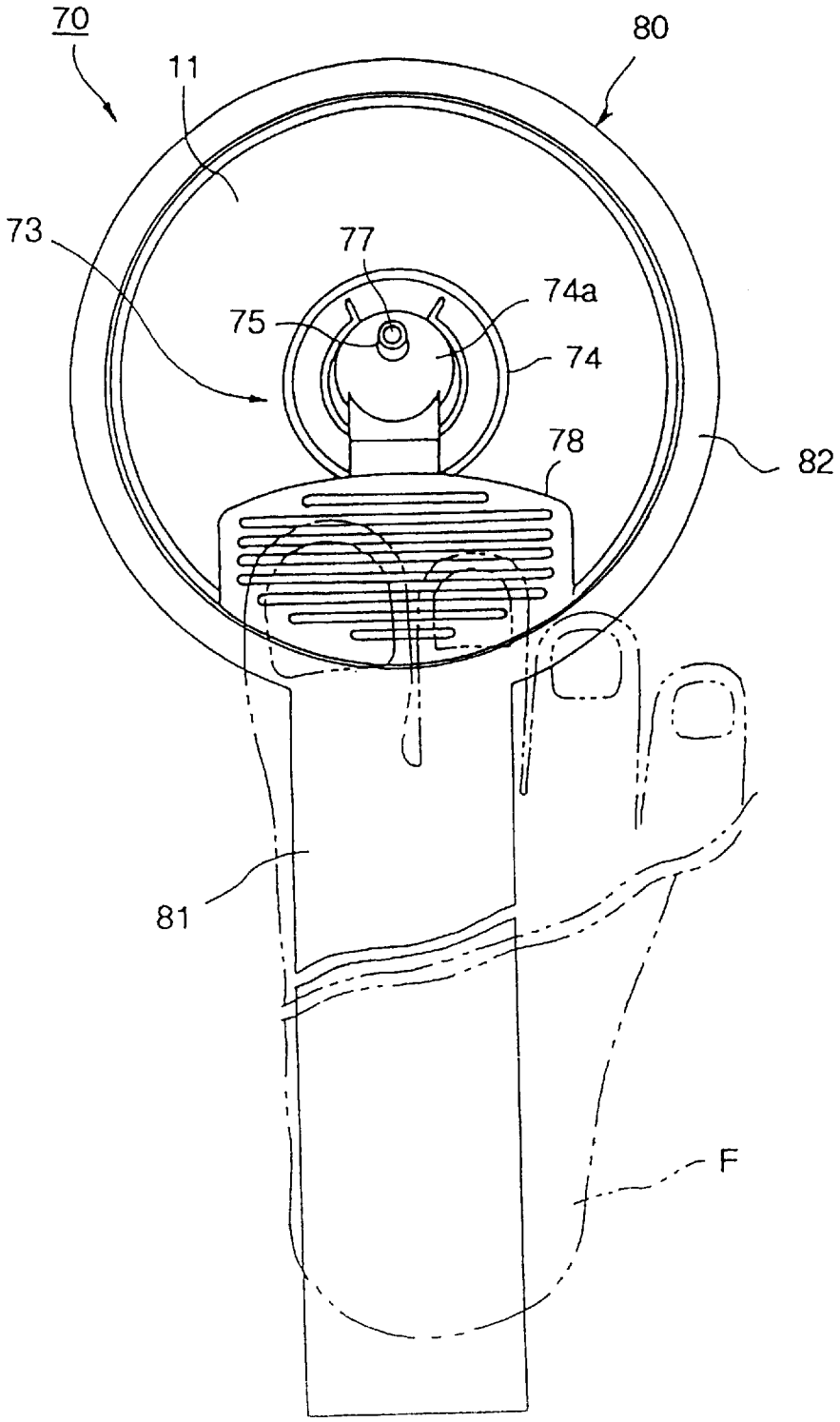
FIG. 12 is a plan view of a ninth embodiment of an aerosol spraying apparatus according to the present invention.

Now, FIG. 12 shows a plan view of a ninth embodiment of an aerosol spraying apparatus according to the present invention. In FIG. 12, an aerosol spraying apparatus 70 comprises an aerosol container 11 which is low in height and has a substantially cylindrical-shaped or substantially hemispherical-shaped outer appearance and, on the upper surface of the aerosol container 11, there is mounted a stem (not shown) in such a manner that it can be slid in the vertical direction. An actuator 73 includes a mounting portion 74 which is fitted with and mounted on a mountain cup (not shown).

The actuator 73 includes a movable portion 74*a* which has a substantially hemispherical-shaped outer appearance, can be moved up and down with respect to the mounting portion 74, and is capable of pressing down the stem. In the movable portion 74*a*, there is formed a connecting passage which communicates with the stem opening of the stem and extends in a direction inclined with respect to the axial direction of the stem. And, on the surface of the movable portion 74*a*, there is projectingly provided a passage portion 75 which includes in the inside thereof an extension passage for extending the connecting passage and has a spray orifice 77 formed in the projecting leading end thereof. From the spray orifice 77, there can be sprayed the aerosol contents in the same direction as the direction in which the connecting passage and extension passage extend.

Also, to the movable portion 74*a*, in more particular, to the opposite side to the side thereof where the passage portion 75 is projectingly provided, there is connected a pedal 78. Here, in the surface of the pedal 78, there is an uneven portion serving as frictional portion for increasing friction resistance. In a plan view, the end portion of the pedal 78, which is located outwardly in the radial direction of the pedal 78, is substantially superimposed on the outer periphery of the aerosol container 11 and does not project beyond the outer periphery of the aerosol container 11.

And, the aerosol spraying apparatus 70 comprises a slippage preventive member 80 which is composed of a band-like member 81 and an annular member 82 connected to one end of the band-like member 81. The slippage preventive member 80 is made of flexible material such as rubber resin and is formed separately from the aerosol container 11. And, the slippage preventive member 80 is arranged such that the annular member 82 is fitted with the outside of the aerosol container 11 and one end of the band-like member 81, in a plan view of the slippage preventive member 80, extends outwardly in the radial direction of the aerosol container 11 to touch the installation surface of the aerosol container 11. The band-like member 81 extends along the extension direction of the pedal 78.

To use the thus structured aerosol spraying apparatus 70, a user may tread the portion of the band-shaped portion 81 that is in touch with the installation surface of the aerosol container 11, for example, by the heel of user's foot F and, at the same time, may operate the pedal 78, for example, by the toes of the foot to thereby be able to press down the stem. In this operation, the aerosol container 11 is retained by the annular member 82 which is connected to the band-like member 81.

According to the present aerosol spraying apparatus 70, the slippage preventive member 80 prevents the aerosol container 11 against slippage and fall-down, which makes it possible to press down the stem positively. Therefore, a stable spraying operation can be carried out through the treading operation.

Also, since the slippage preventive member 80 is formed of flexible material, it can be folded up small and thus it does not bulk.

Figure 13:
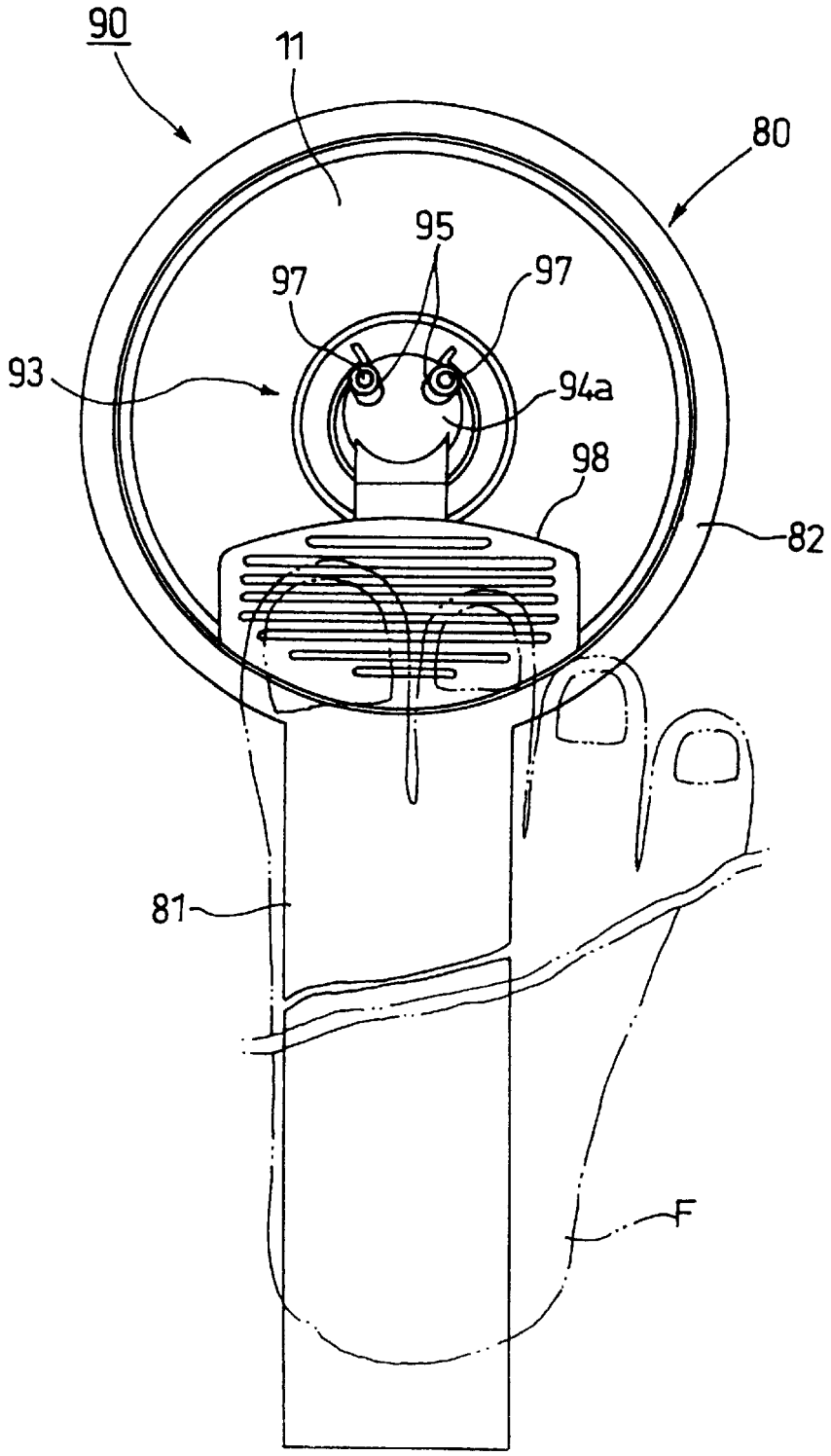
FIG. 13 is a plan view of a tenth embodiment of an aerosol spraying apparatus according to the present invention.

Now, FIG. 13 shows a plan view of a tenth embodiment of an aerosol spraying apparatus according to the present invention. In the present embodiment, the actuator of the ninth embodiment is changed, whereas the remaining portions of the present embodiment are the same as those of the ninth embodiment and thus the description thereof is omitted here.

An actuator 93, which is fitted with and mounted on the upper surface of an aerosol container 11, is structured in such a manner two passage portions 95 are provided on and projected from a movable portion 94*a* having a substantially hemispherical-shaped outer appearance. The spray orifice 97 of each of the two passage portions 95 communicates with the stem opening of a stem through a connecting passage formed in the inside of the movable portion 94*a* and extending in a direction inclined with respect to the axial direction of the stem.

The two passage portions 95 are disposed on the opposite side to the side of the movable portion 94*a* where a pedal 98 is provided, and are structured such that they are able to spray the aerosol contents respectively in different directions which are not a direction toward the user. Here, in a plan view of the aerosol spraying apparatus, the aerosol contents are sprayed from the two passage portions 95 in one direction and in the other direction respectively along a direction perpendicular (in FIG. 13, in the right and left direction) to a direction where the pedal 98 extends.

According to the thus structured aerosol spraying apparatus 90, since the aerosol contents can be sprayed at the same time in two directions which are respectively different from the direction of the user, the aerosol contents can be quickly diffused into the ambient atmosphere.

Figure 14:
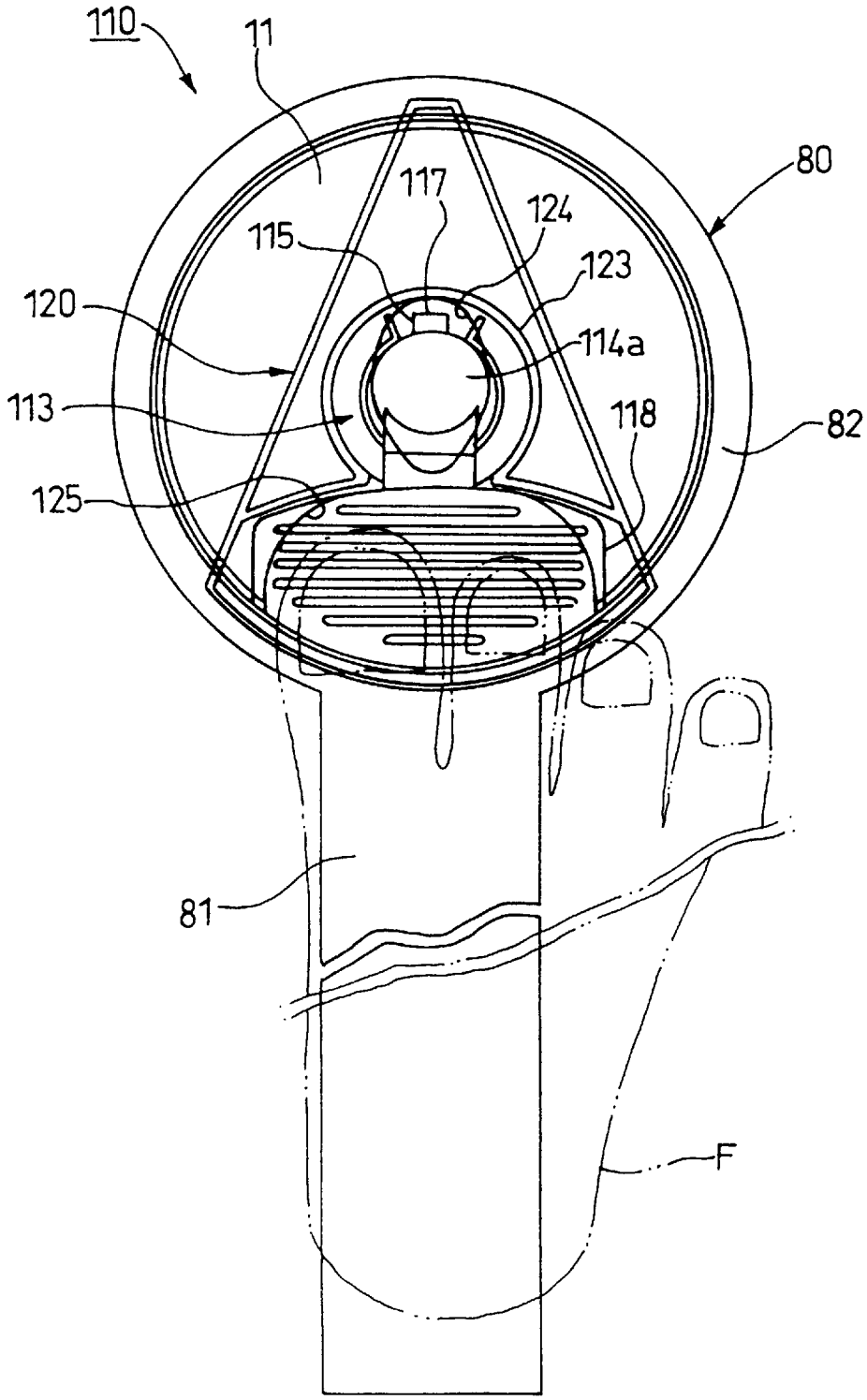
FIG. 14 is a plan view of an eleventh embodiment of an aerosol spraying apparatus according to the present invention.
Figure 15:
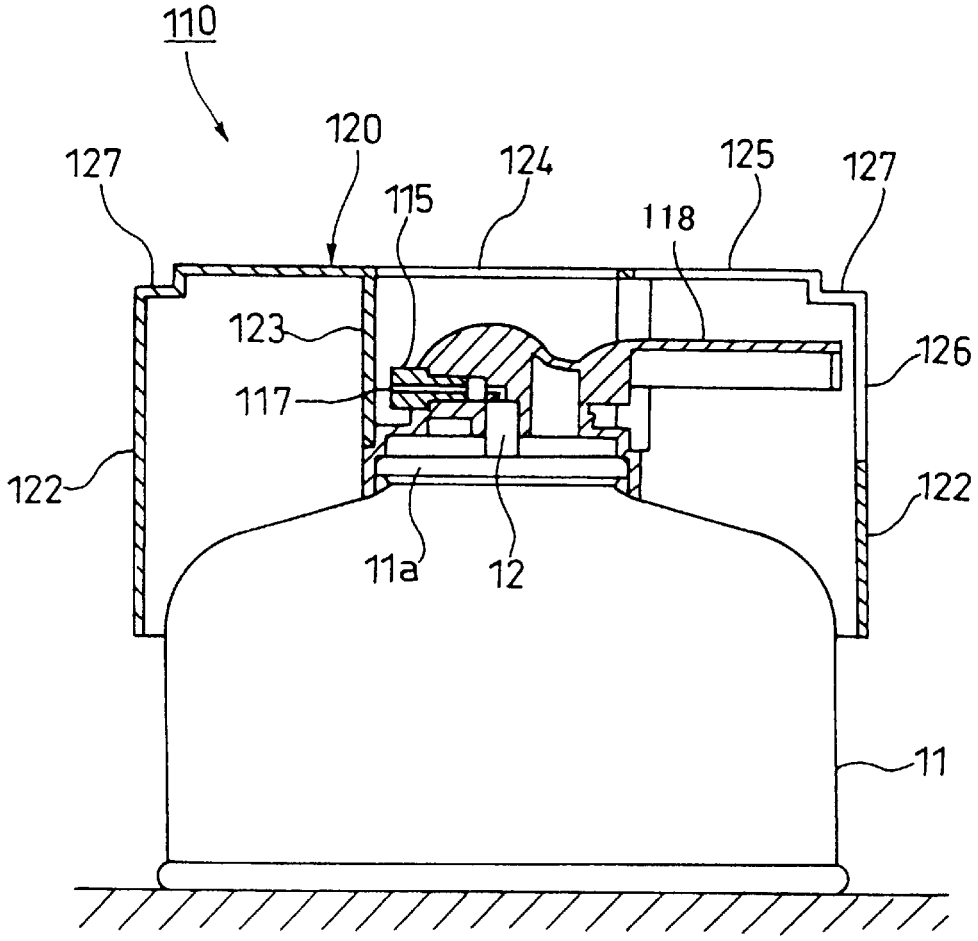
FIG. 15 is a section view of the aerosol spraying apparatus shown in FIG. 14.

Now, FIGS. 14 and 15 show an eleventh embodiment of an aerosol spraying apparatus according to the present invention. In the eleventh embodiment, the actuator of the ninth embodiment is changed and further an upper portion cover 120 is put on the aerosol container 11. Here, a passage portion 115 extends in a direction perpendicular to the axial direction of a stem 12 and in the opposite direction of the extension direction of a pedal 118.

Figure 16:
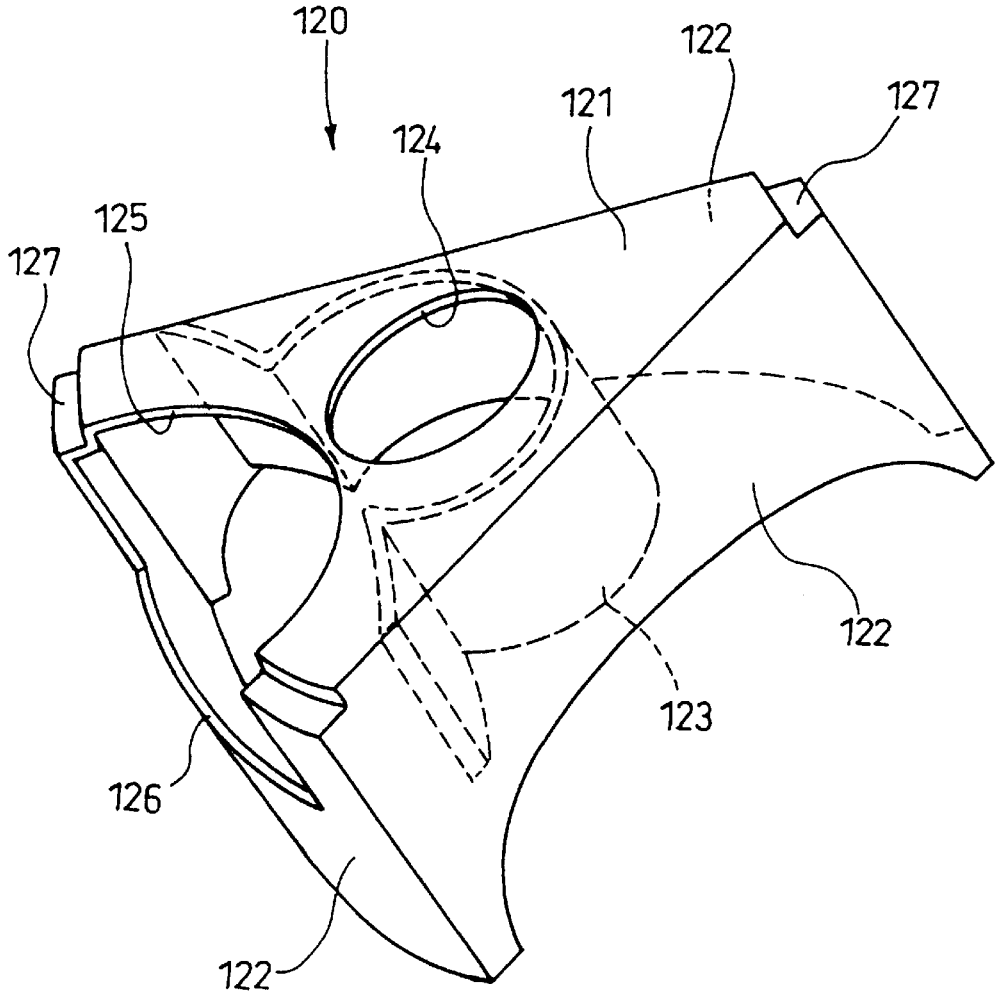
FIG. 16 is a perspective view of an upper cover used in the aerosol spraying apparatus shown in FIG. 15.

And, FIG. 16 shows a perspective view of the upper portion cover 120. The upper portion cover 120 is formed of translucent resin, and it also includes a substantially triangular-shaped ceiling plate 121 and a side wall 122 hanging down from the outer peripheral edge of the ceiling plate 121. Further, from the ceiling plate 121, there hangs down a substantially cylindrical-shaped mounting wall 123 the leading end of which can be fitted with the mountain cup of the aerosol container 11. And, in the ceiling plate 121, as shown in FIG. 14, in a plan view of the present aerosol spraying apparatus, there are formed a passage opening 124 for exposing the inner surface portion of the mounting wall 123 opposed to the spray orifice 117 of the passage portion 115 to the outside, and a pedal opening 125 for exposing the pedal 18 to the outside. The pedal opening 125 is formed along one side of the ceiling plate 121.

Further, as shown in FIG. 16, in the side wall 122 hanging down from the side, along which the pedal opening 125 is formed, of the ceiling plate 121, there is formed a press-down opening 126 for allowing pressing-down of the pedal. Also, in the side of the ceiling board 121 where the pedal opening 125 is formed, and in the vertex portion of the ceiling board 121 which is located on the opposite side of the present side, there are formed step portions 127 respectively. These two step portions 127 are arranged on the same circumference so that the peripheral edge portion of the lower surface of the aerosol container 11 can be engaged with them.

According to the thus structured aerosol spraying apparatus 110, since the passage opening 124 and pedal opening 125 are formed in the upper portion cover 120 to be put on the upper portion of the aerosol container 11, the pedal 118 can be pressed down through the pedal opening 125 without removing the upper portion cover 120. And, the aerosol contents, which have been sprayed out from the spray orifice 117 of the passage portion 115 as the result of such pressing-down of the pedal 118, can be guided upwardly by the mounting wall 123 and can be then diffused from the passage opening 124 to the outside. In more particular, as the result that the pedal 118 shown in FIG. 15 is pressed down, the stem (tilt valve) 12 is inclined and the passage portion 115 is thus inclined to thereby face the spray orifice 117 upwardly, so that the aerosol contents sprayed from the spray orifice 117 can be guided upwardly by the mounting wall 123.

Also, according to the aerosol spraying apparatus 110, as shown in FIG. 15, since the step portions 127 are formed in the upper portion cover 120, two or more aerosol spraying apparatus 110 can be piled on top of another and, therefore, they are easy to display and keep.

The present embodiment can be changed properly: for example, the mounting wall 123 may be inclined so that the aerosol contents can be guided in a direction going away from the user; or, the aerosol contents sprayed from the spray orifice 117 may be diffused to the outside directly through the passage opening 124 without touching the mounting wall 123. Also, the passage opening 124 and pedal opening 125 may be connected to each other. Further, in the present embodiment, the mounting wall 123 also has a guide function. However, there may also be provided another guide means separately from the mounting wall 123.

Figure 17:
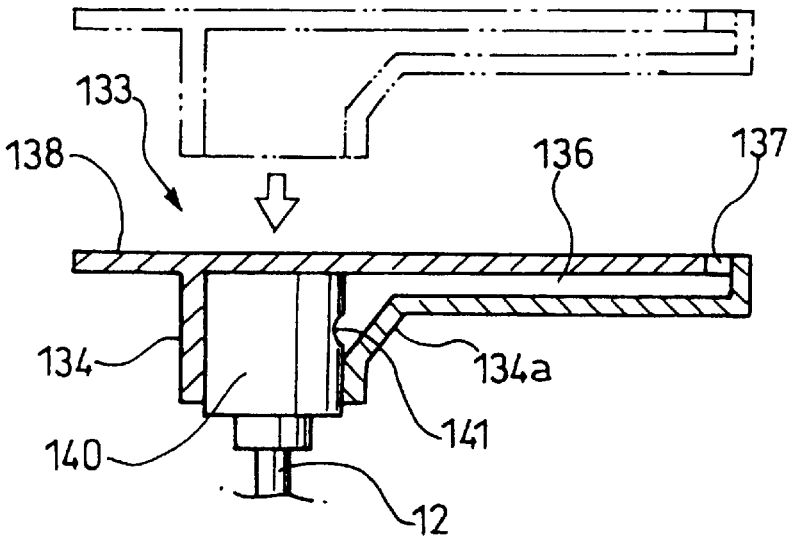
FIG. 17 is an enlarged section view of the main portion of a twelfth embodiment of an aerosol spraying apparatus according to the present invention.
Figure 18:
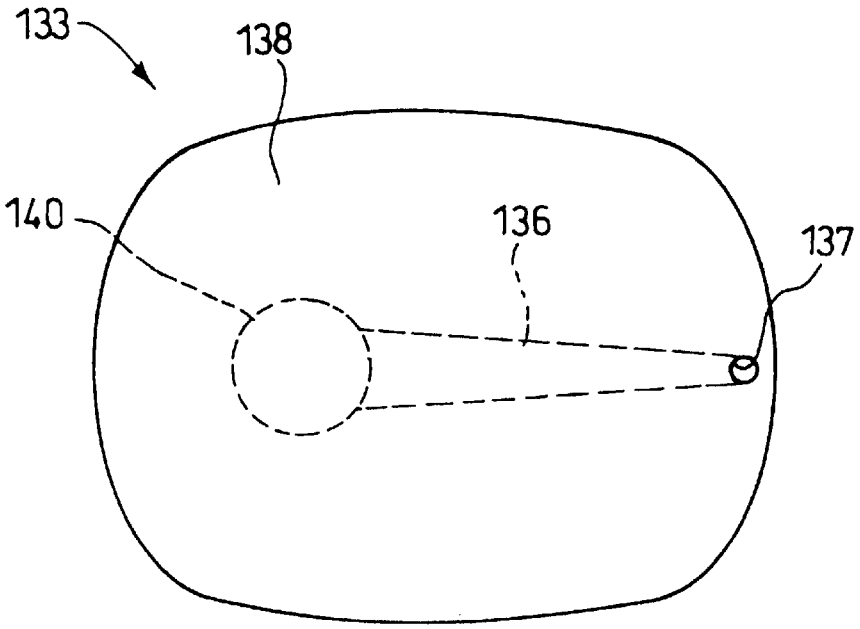
FIG. 18 is a plan view of the twelfth embodiment shown in FIG. 17.

Now, FIGS. 17 and 18 show a twelfth embodiment of an aerosol spraying apparatus according to the present invention. In the present embodiment, a well-known push button 140 having a substantially cylindrical-shaped outer appearance is mounted on a stem 12 and also, on the push button 140, there is mounted an actuator 133 which is produced separately from the push button 140.

As shown in FIG. 17, the actuator 133 includes a mounting portion 134 which can be fitted with the outer periphery of the push button 140, and a pedal 138 having a connecting passage 136 formed therein. The connecting passage 136 is formed such that one end thereof communicates with a stem opening 141 formed in the push button 140 and the other end thereof communicates with a spray orifice 137 formed in the upper surface of the pedal 138. In the mounting portion 134, there is provided an inclined wall 134*a* which is used to prevent the passage from being curved suddenly in the area ranging from the stem opening 141 of the push button 140 to the connecting passage 136. As shown in FIG. 18, the width of the connecting passage 136 narrows from one end thereof connected to the push button 140 toward the other end thereof connected to the spray orifice 137.

According to the above structured aerosol spraying apparatus, by mounting the separately produced actuator 133, the connecting passage 136 and spray orifice 137 can be connected to the stem opening 141 of the push button 140. Thanks to this, the stem 12 with the push button 140 mounted thereon can be pressed down from just above and, therefore, in a plan view of the present aerosol spraying apparatus, the aerosol contents can be sprayed at a position eccentric from the stem opening of the stem 12.

Figure 19:
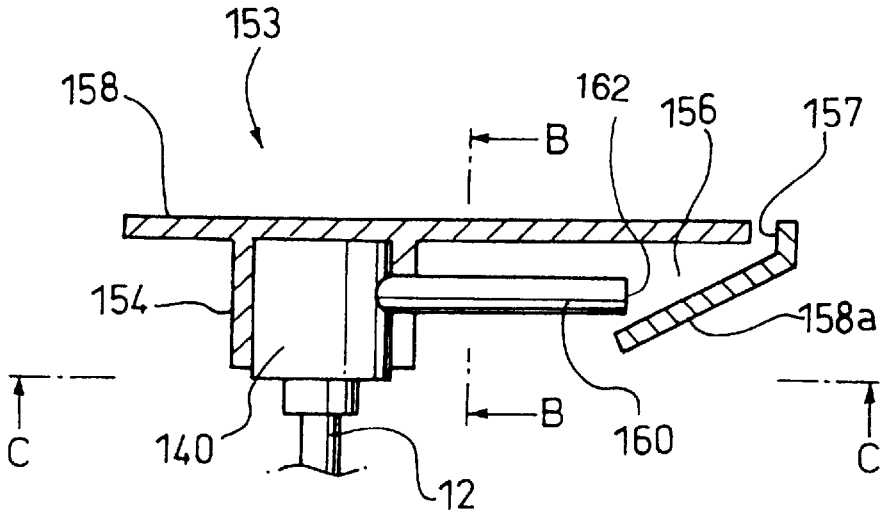
FIG. 19 is an enlarged view of the main portion of a thirteenth embodiment of an aerosol spraying apparatus according to the present invention.
Figure 20:
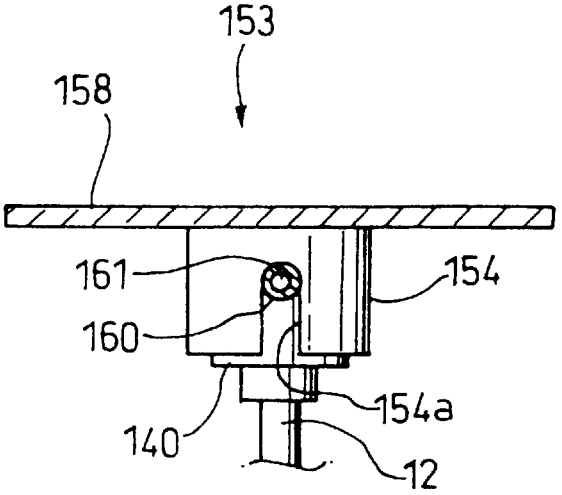
FIG. 20 is a section view taken along the line B—B shown in FIG. 19.
Figure 21:
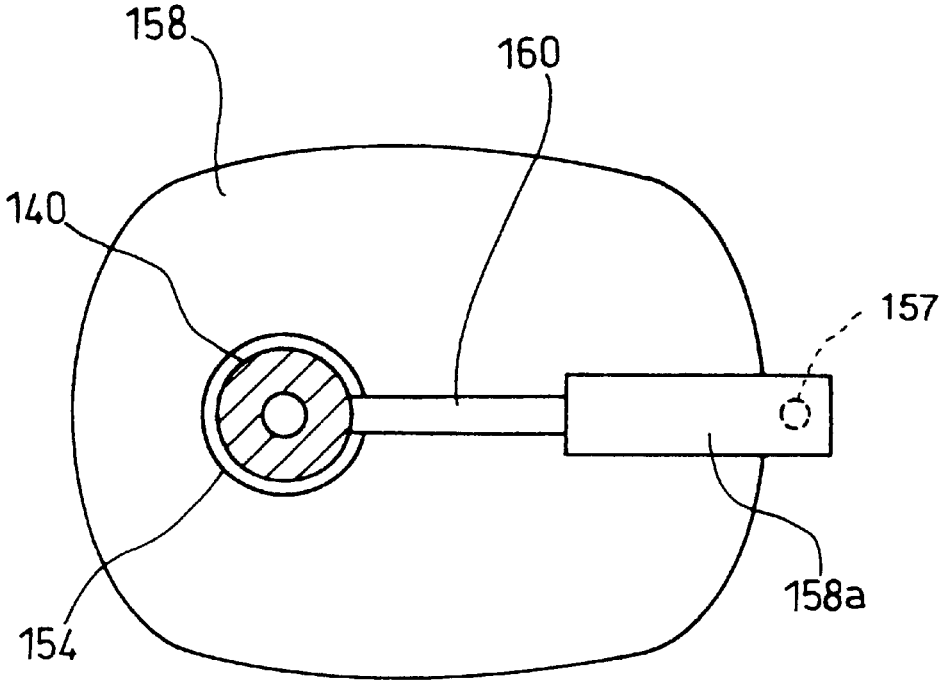
FIG. 21 is a section view taken along the line C—C shown in FIG. 19.

Now, FIGS. 19 to 21 show a thirteenth embodiment of an aerosol spraying apparatus according to the present invention. In the present embodiment, a push button 140 is mounted on a stem 12 and a spray tube 160 is mounted on the stem opening of the push button 140. The spray tube 160 is inserted into the push button 140 in such a manner that it extends in parallel to a pedal 158 disposed in an actuator 153.

As shown in FIG. 20 which is a section view taken along the arrow mark B—B shown in FIG. 19, in a mounting portion 154, there is formed a notch 154*a* which is used to avoid interference with the spray tube 160. In the inside of the spray tube 160, there is formed a passage 161 which communicates with an opening 162 formed in the leading end of the spray tube 160. And, FIG. 21 is a section view taken along the arrow mark C—C shown in FIG. 19.

As shown in FIG. 19, in the upper surface of the pedal 158, there is formed a spray orifice 157. And, in the pedal 158, there is provided a guide wall 158*a* which is used to guide the aerosol contents, which have passed through the passage 161 of the spray tube 160 and have been sprayed out from the leading end opening 162 of the spray tube, to the spray orifice 157. Here, between the guide wall 158*a* and pedal 158, there is formed a connecting passage 156.

According to the above structured aerosol spraying apparatus, by mounting the separately produced actuator 133, the connecting passage 156 and spray orifice 157 can be connected to the spray tube 160 inserted into the push button 140. Thanks to this, the stem 12 with the push button 140 mounted thereon can be pressed down from just above and, therefore, in a plan view of the aerosol spraying apparatus, the aerosol contents can be sprayed at a position eccentric from the stem opening of the stem 12.

Figure 22:
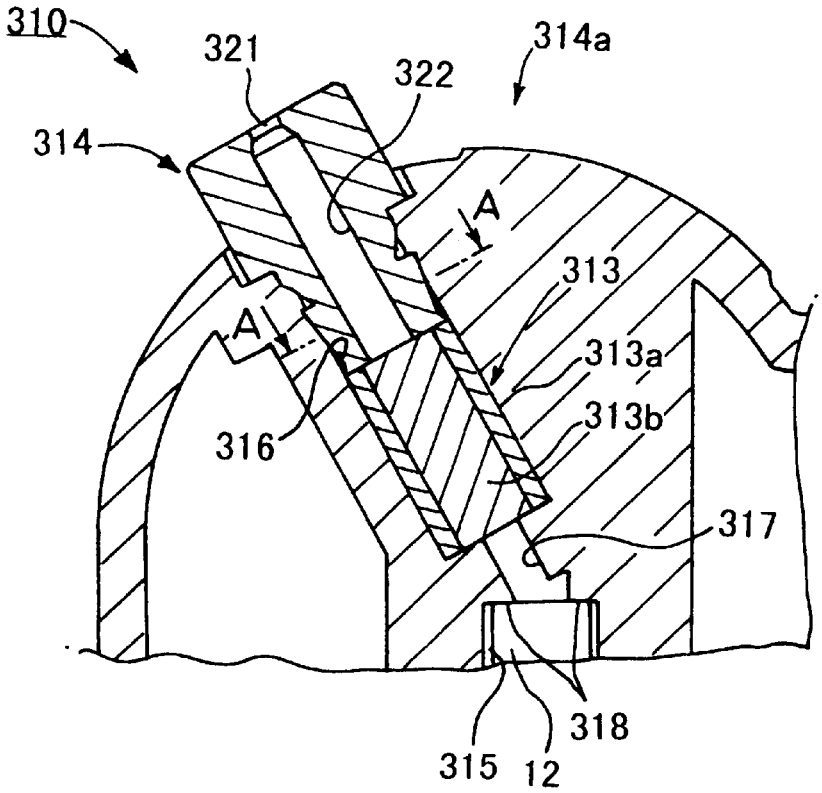
FIG. 22 is an enlarged view of the main portion of a fourteenth embodiment of an aerosol spraying apparatus according to the present invention.

Now, FIG. 22 is a section view of the main portions of a fourteenth embodiment of an aerosol spraying apparatus according to the present invention. In the present embodiment, the movable portion of the first embodiment is changed, whereas the remaining portions thereof (not shown) are identical in structure with those of the first embodiment. Specifically, in the present embodiment, in the lower surface of the movable portion 314*a*, there is formed a first insertion hole 315 into which the leading end of a stem 12 can be inserted. In the upper surface of the movable portion 314*a*, there is formed a second insertion hole 316 into which a retarding member 313 and a stem opening portion 314 can be inserted. The first insertion hole 315 has a circular-shaped cross section and the second insertion hole 316 is formed in such a manner that its section along the arrow mark A—A shown in FIG. 22 is circular; and, the two insertion holes, within the movable portion 314*a*, are allowed to communicate with each other through a communication passage 317 having a circular-shaped section. The diameter of the communication passage 317 is set smaller than the diameter of the insertion hole 315 and, in the connecting portion between the communication passage 317 and insertion hole 315, there is formed a shoulder portion 318.

The retarding member 313 is structured such that the retardative object 313*b* is filled into the inside of a tubular body 313*a* having an outside diameter equal to or slightly smaller than the diameter of the second insertion hole 316. Here, as the retarding member 313, there is used a member which is structured by filling silicone gel into the inside of the a resin tube. The end face of the silicone gel 313*b* in contact with the bottom surface of the second insertion hole 316 is formed as a plane.

Now, description will be given here of a procedure for manufacturing the retarding member 313. At first, in order to enhance the productivity of the retarding member 313, as the pipe-shaped member, there is prepared a long tube. A liquid-state retarding agent is filled into this tube in such a manner that the air is prevented from mixing therewith. After the retarding agent is filled, the end portion of the tube is sealed and the tube is left as it is until the retarding agent is hardened. Finally, the tube is cut to a desired length to thereby manufacture the retarding member.

The stem opening portion 314 is a stepped tubular member, and includes a large diameter portion and a small diameter portion. The small diameter portion of the stem opening portion 314 is inserted into the second insertion hole 316, while a securing projection provided on the outer peripheral surface of the stem opening portion 314 is engaged with a securing recess formed in the second insertion hole 316. On the other hand, the leading end of the large diameter portion of the stem opening portion 314 can be observed visually from the upper surface of the movable portion 314*a*. In the leading end face of the large diameter portion, there is formed a spray orifice 321. The spray orifice 321 communicates with a spray passage 322 which extends toward the small diameter portion end face on the opposite side within the stem opening portion 314. The spray passage 322 has a circular-shaped section and the diameter of the spray passage 322 is set larger than the diameter of the spray orifice 321. Also, here, the diameter of the spray passage 322 is set smaller than the inside diameter of the tubular body 313*a* of the retarding member 313.

Next, description will be given below of the operation of the present embodiment. In case where the operation portion (not shown) of the present aerosol spraying apparatus is pressed down by hand or by foot, the movable portion 314*a*, which is formed integrally with the operation portion, is also pressed down. At the then time, the stem 12 is pressed down by the shoulder portion 318 of the movable portion 314*a*. And, in order to be able to maintain the pressed-down state of the stem 12, the pressed-down operation portion is fixed by retaining means (not shown). Due to this, the aerosol contents can be jetted out continuously from the stem 12.

The aerosol contents jetted out from the stem 12 pass through the communication passage 317 and are then contacted with the plane-shaped bottom surface of the retardative object 313*b*. As a result of this, the internal pressure in the aerosol container starts to push out the retardative object 313*b* from the retarding member 313.

The retardative object 313*b* is next pushed into the spray passage 322. And, the retardative object 313*b* further becomes smaller and moves to the spray orifice 321 side; and, at the time when the retardative object 313*b* is discharged to the outside from the spray orifice 321, the aerosol contents can be sprayed to the outside through the spray orifice 321.

In the above structured aerosol spraying apparatus 310, the long retarding member 313 having a given dimension can be easily manufactured and also the retarding member 313 manufactured can be easily assembled in a given portion of the passage. That is, the easy manufacture of the retarding member 313 can reduce the manufacturing cost of the retarding member 313. Also, the arrangement of the long retarding member 313 in the passage for the aerosol contents can provide a stable delay time.

Also, since the surface formed by the retardative object 313*b* exposed to the bottom surface of the retarding member 313 is formed as a plane and, in the beginning of the operation to press down the stem 12, the aerosol contents jetted out from the stem 12 are butted against the plane-formed bottom surface of the retardative object 313*b*, the delay time can be stabilized further. That is, in case where the bottom surface of the retardative object varies in shape according to products, the delay time also varies; however, in the present aerosol spraying apparatus 310, the bottom surface of the retardative object is always formed as a plane, such variation does not occur in the delay time. By the way, to form or work the bottom surface of the retardative object 313*b* as a plane is relatively easy and thus there is no possibility that such working can incur an increase in the manufacturing cost of the retardative object 313*b*.

Figure 23:
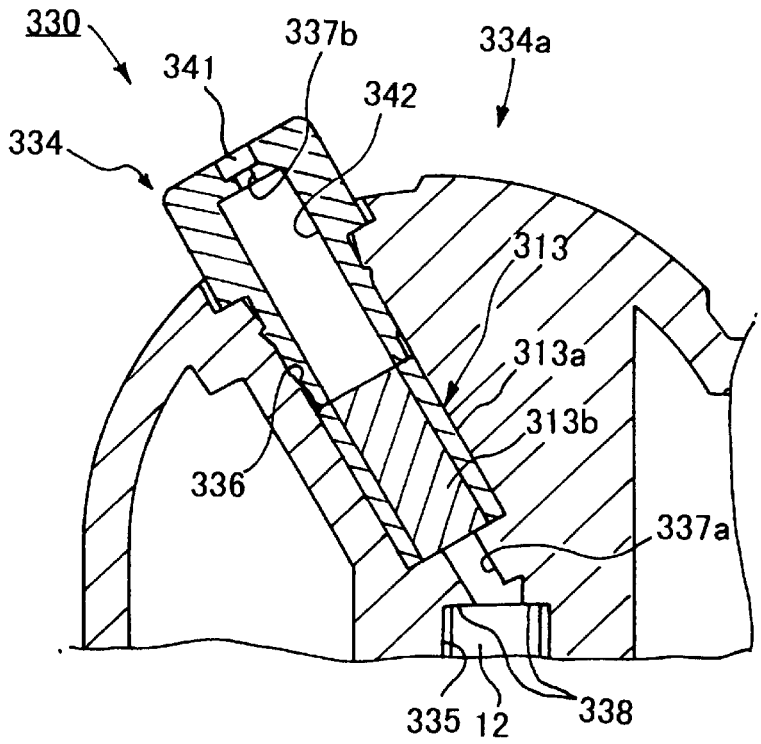
FIG. 23 is an enlarged view of the main portion of a fifteenth embodiment of an aerosol spraying apparatus according to the present invention.

Now, FIG. 23 shows the main portions of a fifteenth embodiment of an aerosol spraying apparatus according to the present invention. By the way, in the embodiment to be discussed below, in the portions thereof (which are not shown), there can be used similar structures to those employed in the first embodiment. Also, the parts that have been already described in the fourteenth embodiment are given the same or like designations and thus the description thereof is simplified or omitted.

As shown in FIG. 23, in the movable portion 334*a* of the aerosol spraying apparatus 330, there are formed a first insertion hole 335 and a second insertion hole 336, while the first insertion hole 335 and second insertion hole 336 communicate with each other through a first communicating passage 337*a* which is smaller in diameter than them. Into the second insertion hole 336, there is inserted a retarding member 313 which is similar to that used in the fourteenth embodiment.

A stem opening portion 334 is a stepped tubular member and includes a large diameter portion and a small diameter portion; and, in the leading end face of the large diameter portion, there is formed a spray orifice 341. The spray orifice 341, within the stem opening portion 334, communicates with a spray passage 342 through a second communicating passage 337*b* having a smaller diameter than the spray orifice 341. The spray passage 342 has a circular section and the diameter of the spray passage 342 is set larger than the diameter of the spray orifice 341. And, here, the diameter of the spray passage 342 is set so as to be equal to the inside diameter of the tubular body 313*a* of the retarding member 313.

In the present embodiment, in case where the stem 12 is pressed down and thus the aerosol contents are continuously jetted out from the stem 12, the retardative object 313*b* of the retarding member 313 is pushed into the spray passage 342. At the then time, the retardative object 313*b* is moved into the spray passage 342 without being caught by the end face of the stem opening portion 334. And, at the time when the retardative object 313*b* moves into the spray passage 342 and is then discharged to the outside from the spray orifice 341, the aerosol contents jetted out from the stem 12 can be sprayed to the outside through the spray orifice 341.

According to the thus structured aerosol spraying apparatus 330, it is also possible to obtain a shorter delay time than that in the fourteenth embodiment by using the retarding member 313 similar to that used in the fourteenth embodiment.

Figure 24:
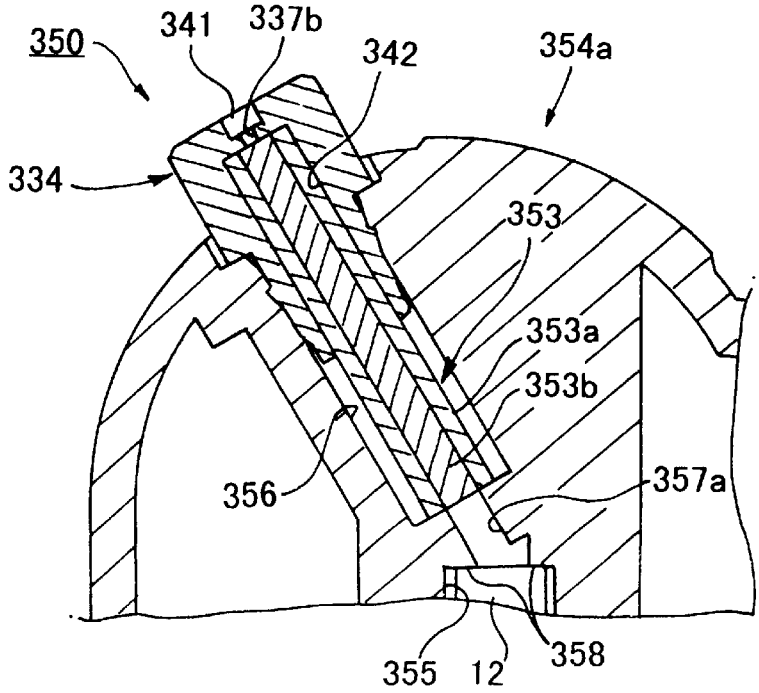
FIG. 24 is an enlarged view of the main portion of a sixteenth embodiment of an aerosol spraying apparatus according to the present invention.

Now, FIG. 24 shows the main portions of a sixteenth embodiment of an aerosol spraying apparatus according to the present invention. As shown in FIG. 24, in the movable portion 354*a* of the aerosol spraying apparatus 350, there are formed a first insertion hole 355 and a second insertion hole 356. In the present embodiment, there is used a retarding member 353 which is finer and longer than the retarding member used in the previously described fourteenth and fifteenth embodiments. The inside diameter of the tubular body 353*a* of the retarding member 353 is set equal to the diameter of a first communicating passage 357*a* which connects the first insertion hole 355 and second insertion hole 356 with each other.

Into the second insertion hole 356, there is inserted one end of the retarding member 353 and there is also fitted a stem opening portion 334 similar to that used in the fifteenth embodiment, whereas the other end of the retarding member 353 is inserted into a spray passage 342 formed in the stem opening portion 334. That is, one end of the retarding member 353 is contacted with the bottom surface of the second insertion hole 356, while the other end of the retarding member 353 reaches a surface in which a second communicating passage 337*b* for connecting together the spray passage 342 and spray orifice 341 within the stem opening portion 334 is formed.

According to the above structured aerosol spraying apparatus 350, there can be obtained a longer delay time than the delay times that can be obtained respectively in the fourteenth and fifteenth embodiments.

Figure 25:
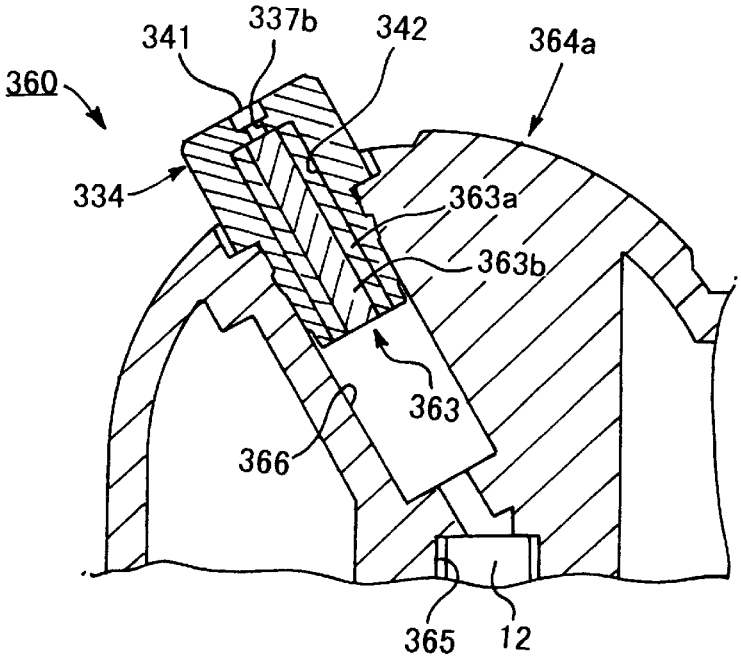
FIG. 25 is an enlarged view of the main portion of a seventeenth embodiment of an aerosol spraying apparatus according to the present invention.

Now, FIG. 25 shows a seventeenth embodiment of an aerosol spraying apparatus according to the present invention. In the present embodiment, the retarding member of the sixteenth embodiment is changed. Here, into a spray passage 342 formed in a stem opening portion 334, there is inserted a retarding member 363 which is equal in length to the spray passage 342. That is, one end of the retarding member 363 provides substantially the same surface as the end portion of the stem opening portion 334, whereas the other end of the retarding member 363 reaches a surface in which there is formed a second communicating passage 337*b* for connecting the spray passage 342 and spray orifice 341 with each other within the stem opening portion 334.

According to the above structured aerosol spraying apparatus 360, there can be obtained a shorter delay time than the delay time obtained in the sixteenth embodiment.

Figure 26:
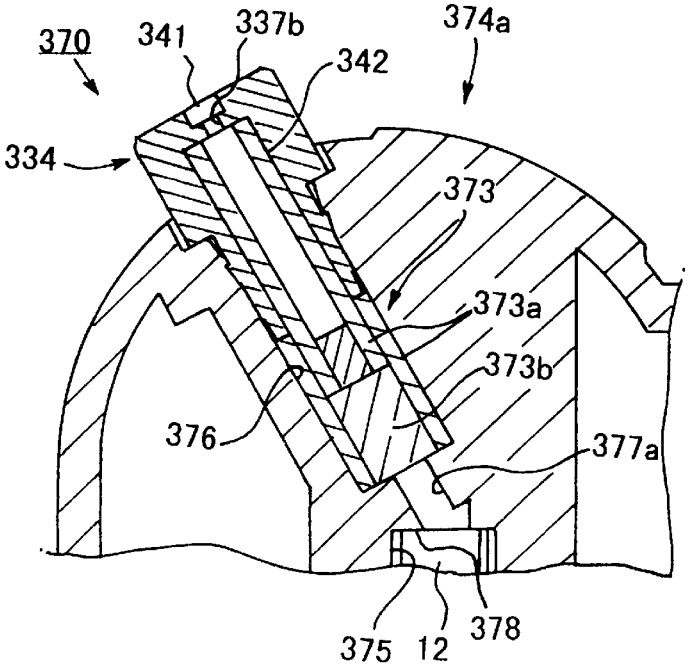
FIG. 26 is an enlarged view of the main portion of an eighteenth embodiment of an aerosol spraying apparatus according to the present invention.

Now, FIG. 26 shows the main portions of an eighteenth embodiment of an aerosol spraying apparatus according to the present invention. In the present embodiment, a retarding member 373 comprises a stepped cylindrical tubular body 373*a* which is composed of a large diameter tubular body having an outside diameter equal to or slightly smaller than the diameter of a second insertion hole 376 and a small diameter tubular body having an inside diameter equal to or slightly smaller than the inside diameter of the large diameter tubular body in such a manner that the small diameter tubular body is inserted into one end of the large diameter tubular body. And, a retardative object 373*b* is filled into the inside of the large diameter tubular body as well as into the portion of the small diameter tubular body that is inserted into the inside of the large diameter tubular body. The retardative object 373*b* is formed in a stepped cylindrical shape the diameter of which decreases step by step toward the spray orifice 341 side.

According to the above structured aerosol spraying apparatus 370, while the retardative object 373*b* becomes smaller with the passage of the time, it moves to the spray orifice side step by step. That is, at the time when the dissolution of the retardative object 373*b* advances and thus it cannot be caught by the end face of the small diameter tubular body any longer, the retardative object 373*b* is pushed into the small diameter tubular body. After then, the retardative object 373*b* moves to the spray orifice 341 side and is then discharged from the spray orifice 341. According to the present embodiment, there can be obtained a very stable delay time.

By the way, in the above-mentioned fourteenth to eighteenth embodiments, the bottom surfaces of the retardative objects 313*b*, 353*b*, 363*b* and 373*b* are respectively formed as a plane. However, this is not limitative but another shape can also be employed, provided that it can be produced repetitively. Also, the inside diameters of the pipe-shaped bodies 313*a*, 353*a*, 363*a* and 373*a* on the stem opening side thereof are respectively set larger than the diameters of their respective spray orifices. This is not limitative, either. For example, in order that the retardative object can be guided to the spray orifice and discharged from the spray orifice, the tubular body can be formed such that it is tapered on the stem opening side thereof; or, in the end portion of the tubular body, there can be formed a wall which is opposed to the spray orifice and, at the same time, in such wall, there can be formed a hole having a diameter smaller than the spray orifice.

Figure 27:
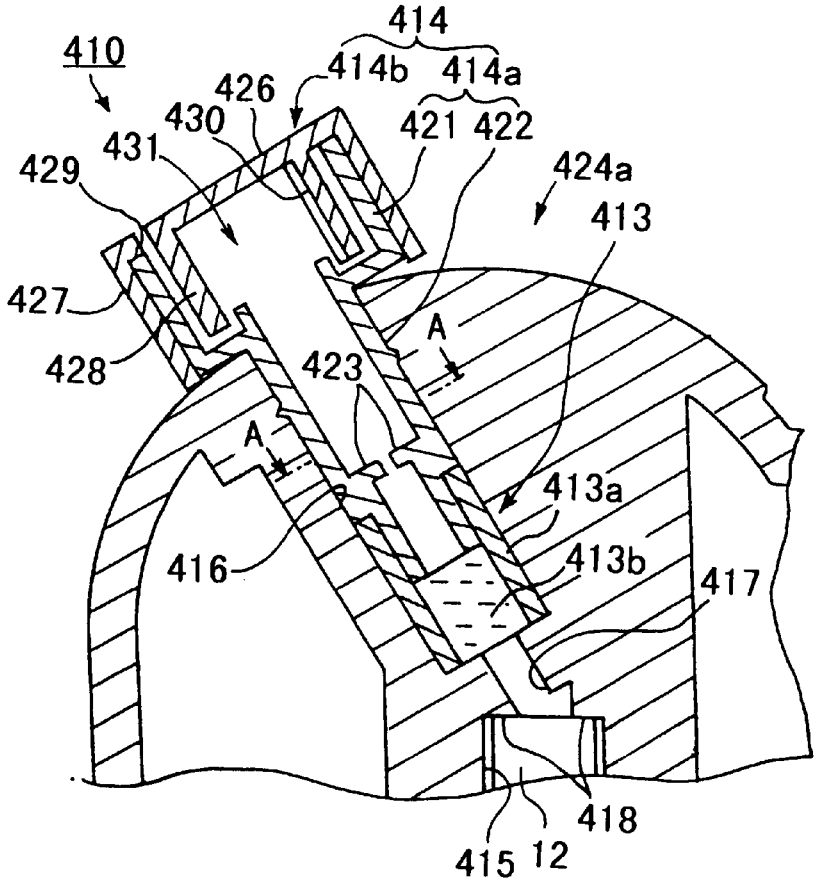
FIG. 27 is an enlarged view of the main portion of a nineteenth embodiment of an aerosol spraying apparatus according to the present invention.

Now, FIG. 27 shows a nineteenth embodiment of an aerosol spraying apparatus according to the present invention. In the present embodiment, in the lower surface of a movable portion 424*a*, there is formed a first insertion hole 415 into which the leading end of a stem 12 can be inserted; and, in the upper surface of the movable portion 424*a*, there is opened up a second insertion hole 416 into which a retarding member 413 and a stem opening portion 414 can be inserted. The first insertion hole 415 has a circular-shaped cross section and the second insertion hole 416 is formed in such a manner that its section along the arrow mark A—A shown in FIG. 27 is circular; and, within the movable portion 424*a*, the two insertion holes communicate with each other through a communication passage 417 having a circular-shaped section. The diameter of the communication passage 417 is set smaller than the diameter of the insertion hole 415 and, in the connecting portion between the communication passage 417 and insertion hole 415, there is formed a shoulder portion 418.

The retarding member 413 is structured such that a retardative object, that is, silicone gel 413*b* is filled into the inside of a tubular body 413*a* having an outside diameter equal to or slightly smaller than the diameter of the second insertion hole 416. In more particular, the silicone gel is filled into only the inside portion of the resin tube 413*a* on one side (on the stem 12 side) thereof, whereas the end portion of the stem opening portion 414 is inserted into the inside portion of the resin tube 413*a* on the other side thereof.

By the way, the structure of the retarding member 413 is not limited to this. For example, a retardative object may be filled into the whole area of the inside of a tubular body and the end portion of the stem opening portion 414 may be arranged so as to adjoin the tubular body. Also, the retarding member may consist of only the retardative object.

The stem opening portion 414 is composed of a stem opening portion main body 414*a* which is a stepped tubular member, and a cap portion 414*b*. The stem opening portion main body 414*a* includes a large diameter portion 421 and a small diameter portion 422. The small diameter portion 422 is inserted into the second insertion hole 416, while a securing projection provided on the outer peripheral surface of the small diameter portion 422 is engaged with a securing recess formed in the second insertion hole 416. The end portion of the small diameter portion 422 is narrowed step by step and is inserted into the resin tube 413*a*.

A space in the inside of the small diameter portion 422 of the stem opening portion main body 414*a* cooperates with the communicating passage 417 adjoining the stem 12 to form part of a passage for the aerosol contents. And, on the inner peripheral surface of the small diameter portion 422, there is provided a stopper 423 which projects inwardly in the diameter direction of the tube on the spray orifice side (on the opposite side to the stem 12 side) at and from the narrowed end portion (which is hereinafter referred to as the inserted end portion). The structure of the stopper 423 is not limited to a special one and, here, as the stopper, there is used a stopper which is has a ring-like shape in a section view taken along the arrow mark A—A shown in FIG. 27. On the stem 12 side at and from the stopper 423, the section of the passage of the small diameter portion 422 is narrower than that on the spray orifice side at and from the stopper 423. By the way, the section of the passage in the stopper 423 is further narrower than the section of the passage on the stem 12 side at and from the stopper 423.

The end of the large diameter portion 421 of the stem opening portion main body 414*a*, which is located on the opposite side to the side thereof connected to the small diameter portion 422, is opened; and, the cap portion 414*b* is put on such open end of the large diameter portion 421.

Figure 28:
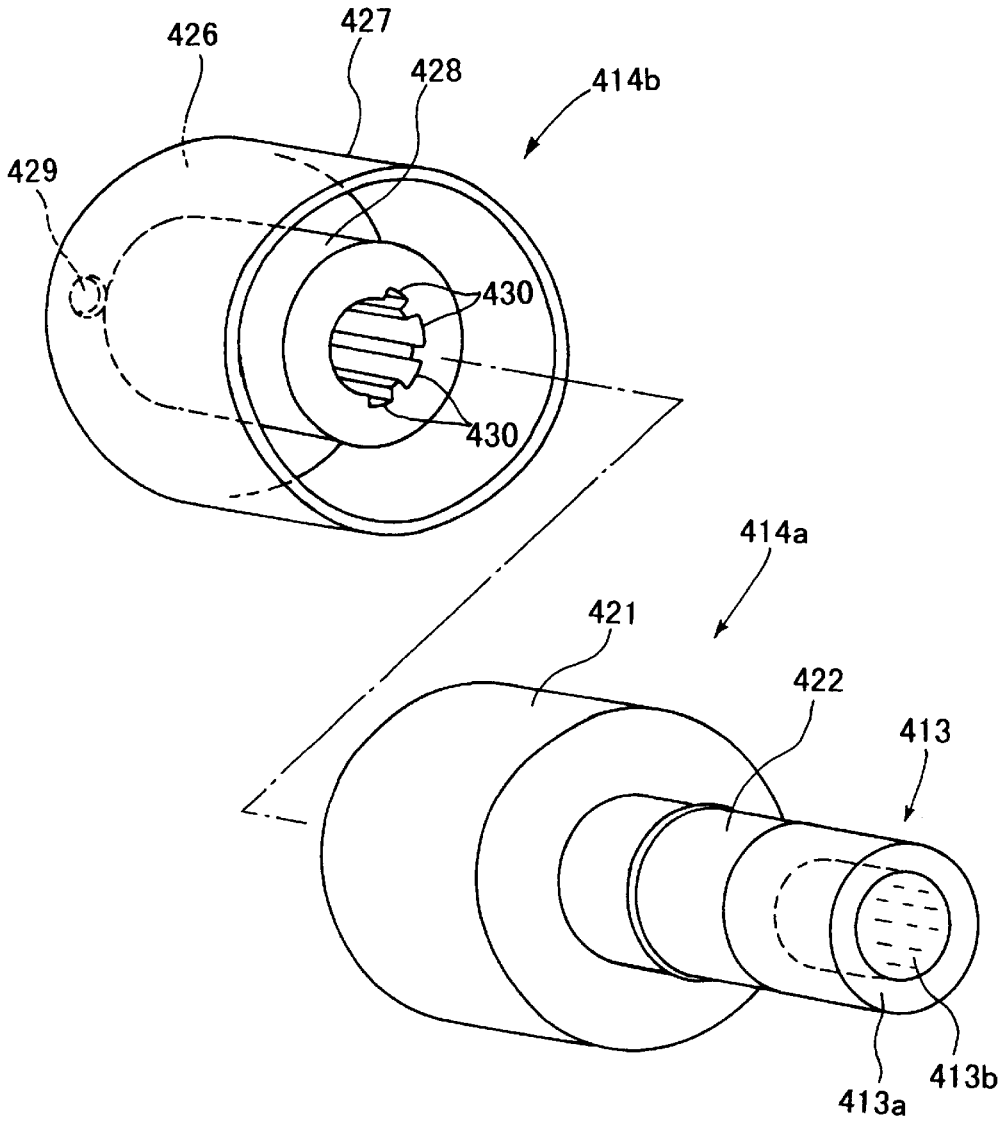
FIG. 28 is an exploded perspective view of a stem opening used in the nineteenth embodiment shown in FIG. 27.

Now, FIG. 28 shows an exploded perspective view of the stem opening portion main body 414*a* and cap portion 414*b*. The cap portion 414*b* is structured such that, in the peripheral edge of a disk-shaped leading end wall 426, there is erected a peripheral wall 427 and also, in the central portion of the leading end wall 426, there is erected a cylindrical wall 428. Between the peripheral wall 427 and cylindrical wall 428 of the leading end wall 426, there is formed a circular-shaped spray hole 429. And, in the inner peripheral surface of the cylindrical wall 428, there are formed a plurality of recessed strips 430 extending along the axial direction of the cylindrical wall 428, which serve as retaining means.

Now, referring back to FIG. 27, in case where the cap portion 414 is fitted with the large diameter portion 421 of the stem opening portion main body 414*a*, a discharging chamber 431 is divided by the inner surface of the leading end wall 426 and the inner peripheral surface of the cylindrical wall 428 of the cap portion 414*b*. And, the recessed strips 430 are positioned within the discharging chamber 431. The discharging chamber 431 communicates with the spray orifice 429 through a passage which is formed between the inner peripheral surface of the large diameter portion 421 and the outer peripheral surface of the cylindrical wall 428.

Next, description will be given below of the operation of the present embodiment. In case where the operation portion (not shown) is pressed down by hand or by foot, the movable portion 424*a*, which is formed integrally with the operation portion, is also pressed down. At the then time, the stem 12 is pressed down by the shoulder portion 418 formed in the movable portion 424*a*. And, in order to be able to maintain the pressed-down state of the stem 12, the pressed-down operation portion is fixed by retaining means (not shown). As a result of this, the aerosol contents can be jetted out continuously from the stem 12.

The aerosol contents jetted out from the stem 12 are moved through the communicating passage 417 and are then contacted with the bottom surface of the retardative object 413*b*. In response to this, the internal pressure in the aerosol container starts to push the retardative object 413*b* into the inserted end portion of the small diameter portion 422. However, at the then time, the retardative object 413*b* is not yet pushed into the spray orifice 429 side from the stopper 423.

Figure 29:
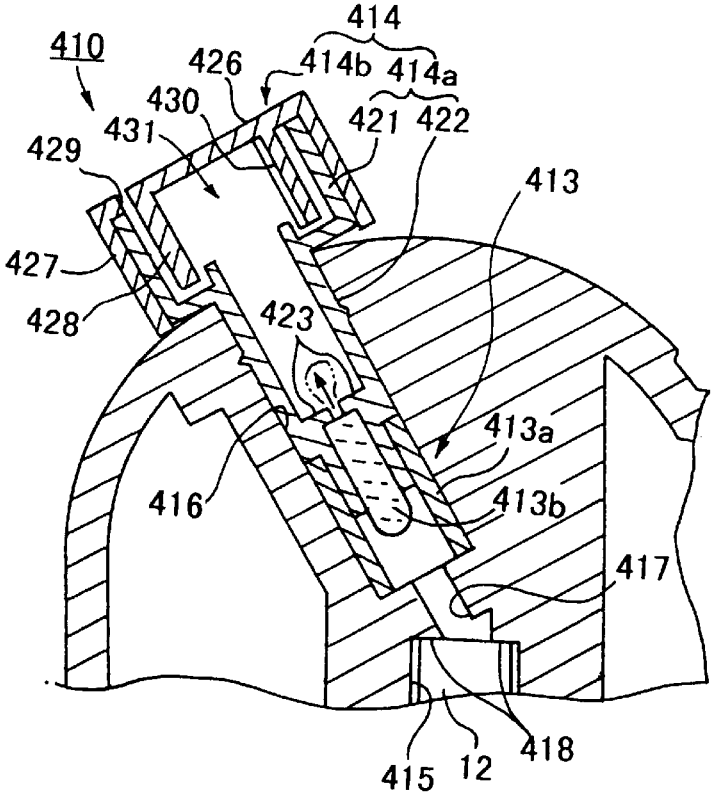
FIG. 29 is a partial section view of the nineteenth embodiment, showing the operation thereof; and, FIG. 30 is also a partial section view of the nineteenth embodiment, showing the operation thereof.

As shown in FIG. 29, in case where the internal space of the inserted end portion is filled with the retardative object 413*b*, the retardative object 413*b*, while varying in shape properly, is next pushed to the spray orifice side of the small diameter portion 422 through the center opening of the stopper 423. And, after passing through the center opening of the stopper 423 completely, the retardative object 413*b* is moved further to the spray orifice 429 side and is then discharged into the discharging chamber 431.

Figure 30:
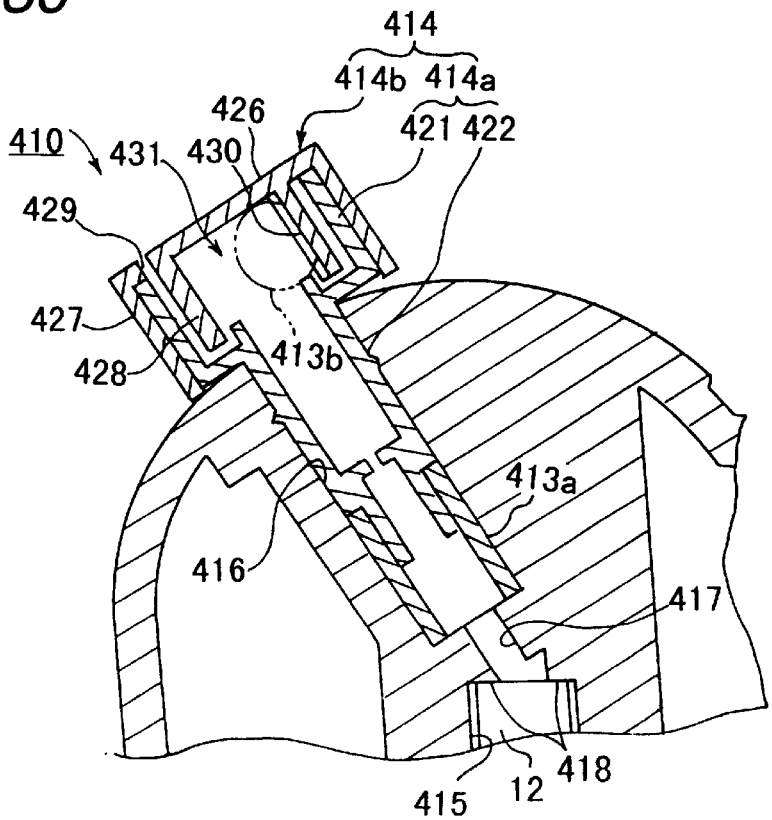

In case where the retardative object 413*b* is discharged into the discharging chamber 431, as shown in FIG. 30, the retardative object 413*b* is secured to the recessed strips 430. By the way, in FIG. 30, the retardative object 413*b* is shown by an imaginary line. At the then time, the stem 12 and spray orifice 429 are allowed to communicate with each other and thus the aerosol contents jetted out from the stem 12 are sprayed to the outside through the spray orifice 429.

In the above structured aerosol spraying apparatus 410, the retardative object 413*b* disposed in the stem 12 side end portion of the second insertion hole 416 are moved by the internal pressure in the aerosol container; and, after the passage of a given time, the retardative object 413*b* are discharged into the discharging chamber 431 and are then secured by the recessed strips 430. Therefore, there is eliminated a possibility that the retardative object 413*b* can move around in the discharging chamber 431 to close the passage of the aerosol contents again, which not only can positively prevent the delay time from varying but also can positively eliminate the possibility that the aerosol contents cannot be sprayed.

In the present embodiment, as the retaining means or catching means within the discharging chamber 431, there are employed the recessed strips 430 which are formed in the inner peripheral surface of the cylindrical wall 428, which makes it possible to simplify the retardative object securing mechanism.

Also, in the present embodiment, the stem opening portion 414 is a separate member from the movable portion 424*a* and it can be post-mounted onto the movable portion 424*a*. Therefore, the stem opening portion 414 is easy to manufacture, thereby being able to provide a good productivity. This stem opening portion 414 is adaptable even to such movable portions and operation means that are different in structure, that is, the present stem opening portion 414 is excellent in versatility.

Further, since the retarding member 413 is structured such that the inside portion of the resin tube 413*a* is filled with the retardative object 413*b*, for example, by changing the length of the resin tube 413*a* or by changing the filling amount of the retardative object 413*b*, the setting of the delay time can be changed easily.

By the way, the present embodiment can be changed or modified properly. For example, there can be formed two or more spray orifices 429.

In the first to nineteenth embodiments, description has been given on the assumption that the aerosol spraying apparatus is used in a state where it is installed on a floor etc. The present inventors have studied the spraying of the aerosol contents deliberately and finally found that, in case where the aerosol contents sprayed from the spray orifice are allowed to reach such position that is distant 2.5 m or more upwardly apart from the floor, the aerosol contents can be diffused effectively into the peripheral ambient. When the aerosol spraying apparatus is used in a state where it is installed on the floor, by adjusting the propellant etc., the spraying pressure of the aerosol contents is increased to thereby allow the aerosol contents to reach such position distant 2.5 m or more upwardly apart from the floor. Also, there can be employed another method in which, by using the aerosol spraying apparatus in a state where it hangs on or down from a wall, the aerosol contents are allowed to reach the position distant 2.5 m or more upwardly apart from the floor.

In this manner, by allowing the aerosol contents to reach the position distant 2.5 m or more upwardly apart from the floor, for example, when there are used such aerosol contents containing insecticidal components therein, a harmful insect exterminating effect can be enhanced, which makes it possible to exterminate not only harmful insects lurking on the back side of a kitchen sink but also harmful insects lurking in a cupboard disposed in the higher portion of a kitchen.

To verify experimentally the effectiveness of the arrangement that allows the aerosol contents to reach the position distant 2.5 m or more upwardly apart from the floor, the present inventors prepared two kinds of aerosol spraying apparatus capable of spraying insecticidal components. Both of them were the aerosol spraying apparatus 200 having the structure shown in FIGS. 1 and 2: in particular, in one (an embodiment according to the present invention) of them, the propellant was adjusted so that the aerosol contents were allowed to reach the position distant 2.5 m or more upwardly apart from the floor; and, in the other (comparison example), the propellant was adjusted so that the aerosol contents were allowed to reach a position which is distant 2 m upwardly apart from the floor. Also, there was prepared a room which is furnished with a cupboard and a kitchen sink and has a capacity 35 m3 (height 2.7 m). In the case of the cupboard, there were disposed plastic cups respectively at a height position 1.6 m distant from the floor, at a height position 1 m distant from the floor, and on the back side of the cupboard, and ten Periplaneta fuliginosa (i.e., a kind of cockroaches) were put into the respective plastic cups. Also, in the case of the kitchen sink, there were disposed plastic cups inside and outside the kitchen sink, and ten Periplaneta fuliginosa were put into the respective plastic cups. And, the respective aerosol spraying apparatus were installed on the floor of the room and were made to spray the whole quantity of insecticidal components, and the present inventors observed the conditions of the Periplaneta fuliginosa under the spraying of the whole quantity of insecticidal components. In our observation, at first, we observed the Periplaneta fuliginosa that were knocked down with the passage of the time, and found the knock-down rate (K.D. rate). And, after the passage of one hour from the start of the spraying, the Periplaneta fuliginosa were moved to another clean plastic container, 1 %-sugar water was given at the room temperature of about 25° C. and, after the passage of two hours from the start of the spraying, the lethality of the Periplaneta fuliginosa was found.

The results of the above test are shown in Table 1.

TABLE 1

Test Results

| | | Embodiment | | Comparison Example | |
|---|---|---|---|---|---|
| | | K.D. rate | Lethality | K.D. rate | Lethality |
| Cupboard | Height 1.6 m | 70% | 100% | 0% | 10% |
| | Height 1.0 m | 100% | 100% | 0% | 80% |
| | Back side | 100% | 100% | 100% | 100% |
| Kitchen-sink | Inside | 100% | 100% | 100% | 100% |
| | Outside | 100% | 100% | 90% | 100% |

As can be seen clearly from the above test results shown in Table 1, according to the embodiment of the present invention, the aerosol spraying apparatus is able to exercise a high exterminating ability even against harmful insects lurking at the high positions of the room.

What is claimed is:

1. An aerosol spraying apparatus, comprising:

an aerosol container including a stem provided with a stem opening for jetting aerosol contents, and an actuator which includes an operation portion for operating the stem, and a spray orifice communicated with the stem opening, wherein the operation portion is adapted to successively spray the whole quantity of the aerosol contents from the spray orifice, the operation portion and the spray orifice are arranged at different positions, and the spray orifice is adapted to spray the aerosol contents at an angle in the range of 30° to 85° with respect to an installation surface on which the aerosol container is placed, in order to prevent the aerosol contents from being sprayed from the spray orifice toward the operating position, and the aerosol contents can be sprayed so as to reach a position 2.5 m or more above the installation surface, by adjusting a type and/or compound ratio of a propellant in the aerosol contents, and wherein the aerosol spraying apparatus is a fogger apparatus.

2. An aerosol spraying apparatus as set forth in claim 1, characterized by further comprising slippage preventive means which is disposed on a bottom portion of the aerosol container to be installed on the installation surface, and prevents the aerosol spraying apparatus from slipping out of position on the installation surface.

3. An aerosol spraying apparatus as set forth in claim 1, the aerosol spraying apparatus further characterized in that the aerosol container has a flat shape, wherein the aerosol container is provided with a treading operation means including an operation portion which, when operated or trod by foot, can operate the stem.

4. An aerosol spraying apparatus according to claim 3, wherein a height (H) of the aerosol spraying apparatus is equal to or less than a diameter (L) of a bottom portion of the aerosol container.

5. An aerosol spraying apparatus according to claim 4, the operation portion does not project from a side surface of the aerosol container in a plan view of the spraying apparatus.

6. An aerosol spraying apparatus according to claim 1, wherein the operation portion does not project from a side surface of the aerosol container in a plan view of the spraying apparatus.

7. An aerosol spraying apparatus as set forth in claim 3, characterized by further comprising slippage preventive means including a fixed portion extending outwardly in a radial direction of the aerosol container in a plan view of the aerosol spraying apparatus and fixed onto the installation surface, and a retaining portion, for retaining the aerosol container, connected to the fixed portion.

8. An aerosol spraying apparatus as set forth in claim 1, characterized by further comprising a passage allowing the stem opening of the stem and the spray orifice to communicate with each other, and a retarding member which has a tubular body filled with a retardative object, and is disposed in the passage to retard spraying of the aerosol contents from the spray orifice.

9. An aerosol spraying apparatus as set forth in claim 1, characterized by further comprising a passage allowing the stem opening of the stem and the spray orifice to communicate with each other, and a retarding member disposed in the passage to retard spraying of the aerosol contents from the spray orifice, wherein the aerosol spraying apparatus further comprises a discharging chamber which communicates with the passage and into which the retarding member moved from the passage due to an internal pressure in the aerosol container can be discharged, and catching means for catching the retarding member disposed in the discharging chamber.

10. An aerosol spraying apparatus as set forth in claim 9, characterized in that the catching means is retaining means including at least one of a recessed portion and a projecting portion capable of retaining the retarding member discharged out from the passage.

11. An aerosol spraying apparatus as set forth in claim 1, characterized by further comprising a passage portion forming a part of a passage for allowing the stem opening of the stem and the spray orifice to communicate with each other, a retarding member disposed in the passage, a discharging chamber into which the retarding member moved from the passage due to an internal pressure in the aerosol container can be discharged and which communicates with the passage portion, and catching means for catching the retarding member, wherein the discharging chamber being provided with the catching means.

12. An aerosol spraying apparatus as set forth in claim 9, characterized in that the retarding member has a tubular body filled with a retardative object, wherein, after the retardative object is filled into an inside portion of the tubular body, length of the retarding member can be adjusted.

13. An aerosol spraying apparatus as set forth in claim 8, characterized in that, after the retardative object is filled into an inside portion of the tubular body, length of the retarding member can be adjusted.

14. An aerosol spraying apparatus, comprising:

an aerosol container including a stem provided with a stem opening for jetting aerosol contents, wherein the aerosol container has a tip-preventing shape, wherein the aerosol container is provided with a treading operation means including:

an operation portion which, when operated or trod by foot, can operate the stem, a spray orifice for spraying the aerosol contents to be jetted out from the stem at the time of the operation of the stem at an angle in the range of 30° to 85° with respect to an installation surface on which the aerosol container is placed and also in a direction opposite to a direction toward a treading operation position in a plan view of the aerosol spraying apparatus, wherein the operation portion is adapted to successively spray the whole quantity of the aerosol contents from the spray orifice, and a mounting portion which detachably retains the operation portion to one end of the aerosol container so that the operation portion covers the stem.

15. An aerosol spraying apparatus as set forth in claim 14, characterized in that the treading operation means is set in such dimension that the treading operation means does not jut out from a side wall surface of the aerosol container, the treading operation means is detachably mounted onto an upper portion of the aerosol container so as to cover the stem.

16. An aerosol spraying apparatus, comprising:

an operation portion capable of pressing down a stem having a stem opening and disposed on the upper surface of an aerosol container, a connecting passage extending in an inclined direction with respect to an axial direction of the stem and communicating with the stem opening, and a spray orifice communicating with the connecting passage, wherein the aerosol container is to be installed on the installation surface, the operation portion is adapted to successively spray the whole quantity of the aerosol contents from the spray orifice, and the spray orifice extends in a direction intersecting with the connecting passage so as to upwardly spray the aerosol contents, whereby the operation portion can be pressed down by a foot treading operation around just above the stem without disturbing the spraying of the aerosol contents from the spray orifice.

17. An aerosol spraying apparatus as set forth in any one of claims 1, 14, 16, 7, 8, 9 and 10, characterized by further comprising slippage preventive means, for prevention of slippage with respect to the installation surface, provided on a bottom portion of the aerosol container.

18. An aerosol spraying apparatus as set forth in claim 16, characterized in that the spray orifice is inclined with respect to a direction perpendicular to the connecting passage so as to extend in a direction apart from the stem.

19. An aerosol spraying apparatus, comprising:

an aerosol container including a stem provided with a stem opening for jetting aerosol contents, and an actuator which includes an operation portion for operating the stem, and a spray orifice communicated with the stem opening, wherein a height (H) of the aerosol spraying apparatus is equal to or less than a diameter (L) of a bottom portion of the aerosol container, wherein the operation portion is adapted to successively spray the whole quantity of the aerosol contents from the spray orifice, the operation portion and the spray orifice are arranged at different positions, and the spray orifice is adapted to spray the aerosol contents at an angle in the range of 30° to 85° with respect to an installation surface on which the aerosol container is placed, in order to prevent the aerosol contents from being sprayed from the spray orifice toward the operating position, and the aerosol contents can be sprayed so that they are able to reach a position 2.5 m or more above the installation surface, by adjusting a type and/or a compound ratio of a propellant in the aerosol contents, wherein the aerosol container is provided with a treading operation means, including an operation portion which is operated by a foot, to operate the stem.

20. An aerosol spraying apparatus according to claim 19, wherein the operation portion does not project from a side surface of the aerosol container in a plan view of the spraying apparatus.

21. An aerosol spraying apparatus, comprising:

an aerosol container including a stem provided with a stem opening for jetting aerosol contents, and an actuator which includes an operation portion for operating the stem, and a spray orifice communicated with the stem opening, wherein the operation portion is adapted to successively spray the whole quantity of the aerosol contents from the spray orifice, the operation portion and the spray orifice are arranged at different positions, and the spray orifice is disposed at a position eccentric to operation portion, in order to prevent the aerosol contents from being sprayed from the spray orifice toward the operating position.

* * * * *